US010714067B1

(12) United States Patent
Xu et al.

(10) Patent No.: US 10,714,067 B1
(45) Date of Patent: Jul. 14, 2020

(54) CONTROLLER FOR PRODUCING CONTROL SIGNALS

(71) Applicant: ROLI Ltd., London (GB)

(72) Inventors: Ning Xu, London (GB); Hong Yeul Eom, London (GB); Christopher Slater, London (GB); David A Rumball, London (GB); Thomas J Waldron, London (GB)

(73) Assignee: ROLI Ltd. (GB)

( * ) Notice: Subject to any disclaimer, the term of this patent is extended or adjusted under 35 U.S.C. 154(b) by 0 days.

(21) Appl. No.: 16/428,129

(22) Filed: May 31, 2019

(51) Int. Cl.

| | |
|---|---|
| ***G10H 1/14*** | (2006.01) |
| ***G10H 1/00*** | (2006.01) |
| ***G10H 1/34*** | (2006.01) |
| ***G10H 1/46*** | (2006.01) |
| ***G10H 5/02*** | (2006.01) |

(52) U.S. Cl.
CPC ..... *G10H 1/14* (2013.01); *G10H 1/0008* (2013.01); *G10H 1/0066* (2013.01); *G10H 1/344* (2013.01); *G10H 1/46* (2013.01); *G10H 5/02* (2013.01); *G10H 2210/201* (2013.01); *G10H 2210/281* (2013.01); *G10H 2210/325* (2013.01); *G10H 2210/341* (2013.01); *G10H 2220/221* (2013.01)

(58) Field of Classification Search
CPC ..... G10H 1/14; G10H 5/02; G10H 1/0066; G10H 1/46; G10H 1/344; G10H 1/0008; G10H 2210/325; G10H 2210/281; G10H 2210/201; G10H 2220/221; G10H 2210/341
See application file for complete search history.

(56) References Cited

U.S. PATENT DOCUMENTS 5,003,859 A * 4/1991 Monte ..... G10H 1/182 84/423 R
5,115,705 A * 5/1992 Monte ..... G10H 1/182 338/69
5,144,876 A 9/1992 Hirano
(Continued)

FOREIGN PATENT DOCUMENTS

EP 3301670 A1 4/2018
JP 0627947 A 2/1994

OTHER PUBLICATIONS

EP Search Report for Application No. 19177650.9, 8 pages, dated Oct. 29, 2019.

*Primary Examiner* — Jeffrey Donels

(57) ABSTRACT

A controller, method, system, and computer-readable medium, for producing control signals. The controller comprises a pressure sensor, a hinged input mechanism configured to receive input forces and direct them towards the sensor, and a processor. The processor is configured to receive a signal from the pressure sensor indicating that the hinged input mechanism is being depressed or released and, based on the received signal, to determine, during a time interval, a rate of change of pressure detected at the sensor. The processor also generates a control signal associated with the hinged input mechanism, wherein the control signal comprises a velocity characteristic representing a speed at which the hinged input mechanism is depressed or released, and the velocity characteristic is based at least partly on the determined rate of change of pressure. In one example embodiment, the control signal is an audio control.

19 Claims, 13 Drawing Sheets

(56) References Cited

U.S. PATENT DOCUMENTS

| | | | | |
|---|---|---|---|---|
| 5,495,074 | A * | 2/1996 | Kondo | G10H 1/0558 84/690 |
| 5,552,561 | A | 9/1996 | Nakada et al. | |
| 5,641,930 | A * | 6/1997 | Nakada | G10H 1/0556 84/658 |
| 5,648,630 | A * | 7/1997 | Vandervoort | G10C 3/12 84/600 |
| 6,362,412 | B1 * | 3/2002 | Ura | G10H 1/344 73/488 |
| 6,376,759 | B1 * | 4/2002 | Suzuki | G10H 1/053 84/615 |
| 7,420,114 | B1 * | 9/2008 | Vandervoort | G10H 1/386 84/609 |
| 2004/0065187 | A1 * | 4/2004 | Ludwig | G10H 1/00 84/645 |
| 2008/0087157 | A1 * | 4/2008 | Suzuki | G10D 7/08 84/385 A |
| 2009/0288545 | A1 * | 11/2009 | Mann | G09B 5/06 84/484 |
| 2018/0174560 | A1 * | 6/2018 | Shi | G10H 1/0551 |

* cited by examiner

Fig 1 – Prior art

Detail C

Detail D

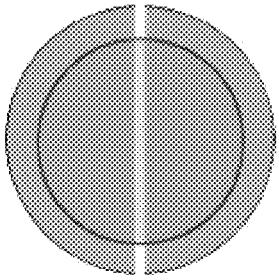
Fig 8a
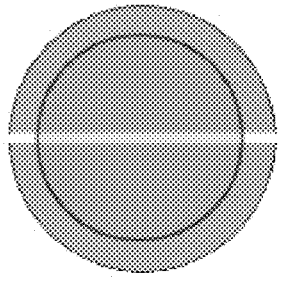
Fig 8b
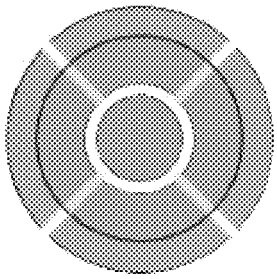
Fig 8c
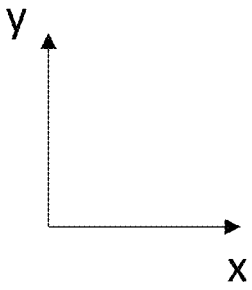

400

CONTROLLER FOR PRODUCING CONTROL SIGNALS

TECHNICAL FIELD

The present disclosure relates generally to a controller for producing control signals. More specifically, but not exclusively, the present disclosure relates to a controller for producing audio control signals, such as MIDI signals, using a hinged key of digital keyboard.

BACKGROUND

Digital music keyboards (which will be referred to as simply "digital keyboards" or "keyboards" hereafter) are the most common input interface for controlling software synthesizers for generating music and audio. Software synthesizers typically offer large libraries of versatile sounds. Compared to the extremely diverse sounds producible by typical synthesizer software and the large number of customisable parameters associated with each sound, the keyboard interface is rather simple and restrictive. A range of buttons, knobs and faders are thus often added to digital keyboard interfaces to extend the real-time control provided over the software sound parameters. This solution, however, complicates the input device and imposes distractions on the music performance workflow, because interacting with these peripheral features typically requires the musician to move at least one of their hands away from the main performing interface, the keyboard. Moreover, the peripheral control features are usually mapped as a global control for all the notes generated, such that any changes to a feature will result in modifications in all the triggered notes simultaneously. This kind of functionality is known as monophonic control or monophonic aftertouch and limits the versatility and range of expression of the device.

A further problem facing existing digital keyboard and synthesizer interfaces is that velocity characteristics of sounds produced, which reflect the speed at which a key is depressed, are typically calculated based on the difference in time at which a plurality of switches are activated. This method of determining velocity characteristics is complex and is dependent on a plurality of components functioning properly. Relying on a plurality of switches increases the likelihood of inaccuracy or malfunction, because there are numerous elements that can become worn or fail. In addition, in order to enable the key to interface correctly with the plurality of pressure sensors, complex mechanisms to enable the key to pivot or depress in the correct manner need to be provided. The consistency across keys is also poorer due to the increased number of parts, which can lead to increased variability between keys as well as a greater number of parameters to control.

It would be advantageous to provide systems and methods which address one or more of the above-described problems, in isolation or in combination.

OVERVIEW

This overview introduces concepts that are described in more detail in the detailed description. It should not be used to identify essential features of the claimed subject matter, nor to limit the scope of the claimed subject matter.

The present disclosure describes a new design for a controller for producing control signals, for example audio control signals. An associated method of producing said control signals is also disclosed. The disclosed mechanism provides the user with expressive control capabilities that go beyond those provided by traditional controllers, such as mechanical digital music keyboards, while nevertheless preserving the familiarity of the interface. In addition, the disclosed mechanism is simpler and less prone to malfunction than those used in traditional digital keyboards.

According to an aspect of the present disclosure, a controller for producing control signals is disclosed. The controller comprises a pressure sensor and a hinged input mechanism configured to receive input forces and direct said input forces towards the pressure sensor. The hinged input mechanism may be a hinged key, a hinged button or any other suitable hinged input mechanism for receiving inputs. The inputs may be provided by a user, such as by a finger of a user.

The pressure sensor may be provided beneath the hinged key. "Beneath" is in this context to be interpreted as meaning that depression of the hinged input mechanism depresses the input mechanism "downwards" towards the input mechanism. However the terms "beneath" and "downwards" are relative terms to be interpreted in the reference frame of the input mechanism and do not imply any absolute directionality of the device in general. For example, the pressure sensor may not be "beneath" the input mechanism in the reference frame of a user.

The controller further comprises a processor configured to receive a signal from the pressure sensor indicating that the hinged input mechanism is being depressed or released. The term "processor" is to be interpreted broadly as any mechanism for processing data and for performing the processing methods described herein. The processor is not limited to being a traditional integrated-circuit, IC, based processor. The processor may be a field-programmable gate array, FPGA, or a non-IC based detection circuit.

The processor is further configured, based on the received signal, to determine, during a time interval, a rate of change of pressure detected at the pressure sensor and generate a control signal associated with the hinged input mechanism. The time interval can be pre-determined. Alternatively, dynamic filtering techniques may be used to change the time interval dynamically, for example based on a noise level. The control signal comprises a velocity characteristic representative of the speed at which the hinged input mechanism is depressed or released and the velocity characteristic of the control signal is based at least partly on the determined rate of change of pressure.

By determining the velocity characteristic of the control signal based at least partly on the determined rate of change of pressure, only one pressure sensor needs to be utilised. This is in contrast to traditional control mechanisms which determine velocity based on readings from a plurality of switches. The input mechanism is thereby simplified and less prone to error.

The control signal may be an audio control signal, and the controller may be provided as part of an audio control device or musical instrument, such as a digital keyboard or synthesizer. The term "audio control signal" is herein to be interpreted broadly. The control signal may be a control signal for synthesis control parameters, which is a generic control signal produced according to the MIDI framework. Thus, the "audio control signal" may in fact comprise a control signal generated before the synthesizer renders any audio.

The processor may be further configured to generate a modified version of the audio control signal comprising aftertouch characteristics when the pressure detected at the pressure sensor is above a threshold. Aftertouch characteristics relate to characteristics of the sound produced by depression of an input mechanism when additional pressure is applied to the input mechanism after the input mechanism has been struck or depressed and while it is being held down or sustained. By providing aftertouch functionality, the expressive capacity of the device is extended. By providing aftertouch functionality after a particular pressure threshold is reached, the aftertouch functionality can be associated with a particular phase or degree of input mechanism depression, which can enable the user to more precisely control when the aftertouch functionality is provided. For example, a light depression of the input mechanism may result only in initiation of a sound, whereas firm depression of the input mechanism may result in aftertouch effects being applied to the sound.

Generating the modified audio control signal to comprise aftertouch characteristics may comprise modifying the initial control signal so that it comprises one or more of: a vibrato effect; a pitch bending effect; a modified volume; a modified timbre; a modified rhythm; an additional sound type; or/and a spatial effect, optionally a delay, reverb and/or panning effect. Other types of aftertouch characteristic will be apparent to a person skilled in the art. Modifying the initial control signal may comprise modifying a characteristic or parameter already present in the initial control signal or adding an entirely new characteristic or parameter to the initial control signal. The processor may be configured to further modify the audio control signal when the pressure detected at the pressure sensor changes but remains above the first threshold. In other words, the aftertouch effect applied to the sound may vary based on how hard the input mechanism is depressed beyond a given threshold. The user may therefore be able to provide varying aftertouch effects, which further increases the expressive range of control over the device.

The audio control signal generated can be a MIDI Note On message or a MIDI Note Off message, where a MIDI Note On message is generated on depression of the input mechanism and a MIDI Note Off message is generated on release of the input mechanism.

There may be a plurality of hinged input mechanisms and the control mechanism of the present disclosure may be incorporated into one or more, typically all, of the hinged input mechanisms of the plurality. Thus, references to "the input mechanism" should throughout be construed as meaning "the or each input mechanism", depending on whether or not there are a plurality of input mechanisms comprising the mechanism of the present disclosure.

The processor may be configured to generate an individual audio control signal with individual aftertouch characteristics for each respective hinged input mechanism. The audio control signal and associated aftertouch characteristics for each respective hinged input mechanism may be independent of the audio control signal and associated aftertouch characteristics for each other hinged input mechanism. The processor may be configured to generate more than one individual audio control signal with individual aftertouch characteristics concurrently. Thus, polyphonic aftertouch functionality may be provided, whereby aftertouch effects can be provided individually to each specific input mechanism of the plurality. This may again increase the expressive range of control provided to the user.

The hinged input mechanism may be configured to provide a first returning force in response to being depressed, the first returning force being operable to return the hinged input mechanism to a rest position. The first returning force may arise as a result of the input mechanism comprising an elastic or resilient material which resists depression or bending.

The controller may further comprise a force direction element provided between the hinged input mechanism and the pressure sensor, wherein the force direction element is configured to direct input forces applied to the hinged input mechanism to the pressure sensor. The force direction element may be compressible. The force direction element may be configured to exert a second returning force on the hinged input mechanism when the hinged input mechanism is depressed, the second returning force being operable to return the hinged input mechanism toward or to a rest position. The second returning force may arise as a result of the force direction element comprising an elastic or resilient material which resists depression or compression.

The controller may further comprise a stopper arranged to engage the hinged input mechanism once the hinged input mechanism has been depressed by a pre-determined distance. The stopper may be compressible. The stopper may be configured to exert a third returning force on the hinged input mechanism when the hinged input mechanism is depressed beyond the pre-determined distance, in other words once the stopper engages the input mechanism. The third returning force can be operable to return the hinged input mechanism toward or to a rest position. The third returning force may arise as a result of the stopper comprising an elastic or resilient material which resists depression or compression.

The force direction element may comprise a less rigid, resilient or elastic material than the stopper, such that the stopper resists compression to a greater extent than the force direction element. The returning force exerted on the hinged input mechanism by the force direction element may therefore increase at a slower rate than the returning force exerted on the hinged input mechanism by the stopper, relative to the distance by which the input mechanism is depressed.

The returning force provided by the hinged input mechanism may increase at a slower rate than both the returning force exerted on the hinged input mechanism by the force direction element and the returning force exerted on the hinged input mechanism by the stopper, relative to the distance by which the input mechanism is depressed. This may result in the input mechanism depression action comprising three distinct phases with differing returning forces provided by the input mechanism to the user during each phase. This may in turn result in the input mechanism depression action comprising three distinct tactile or haptic phases. The tactile phases may correspond to phases of different functionality of the input mechanism. For example, a first phase may be associated with a relatively light tactile pushback force on the user and may be associated with no sound being produced. A second phase may be associated with a relatively medium tactile pushback force on the user and may be associated with a sound being produced. A third phase may be associated with a relatively strong tactile pushback force on the user and may be associated with aftertouch effects being applied to the sound. Intuitive and precise control over the functionality of the device may therefore be provided and the man-machine interface provided by the device may be improved.

The pressure sensor may comprise a plurality of segments and the processor may be further configured to modify the control signal based on the pressure detected at each of the plurality of segments of the pressure sensor. The processor may be further configured to interpolate a plurality of pressure data signals received from the pressure sensor to derive a centroid location of the input to the pressure sensor across the plurality of segments. By providing a plurality of pressure segments, variations in movement in a first and/or second plane across the input mechanism (for example and x and/or a y plane of the input mechanism when viewed from a normal playing position) can be detected and can be used to modulate the control signal, for example to provide aftertouch effects. Thus, additional input modalities can be provided.

A plurality of hinged input mechanisms may be provided and may be arranged above a pressure sensing component, wherein the pressure sensing component comprises a plurality of pressure sensors and wherein at least one pressure sensor is provided beneath each hinged input mechanism. The pressure sensing component may be connected to or provided on a printed circuit board, PCB, for collection of the sensor data generated by the plurality of pressure sensors.

According to a further aspect of the present disclosure, a digital keyboard or synthesizer is disclosed. The digital keyboard or synthesizer may comprise any of the components, controllers or control mechanisms disclosed herein.

According to a further aspect of the present disclosure, a computer-implemented method of generating a control signal for performing by a processor is disclosed. The method comprises receiving a signal from a pressure sensor provided beneath a hinged input mechanism, the received signal indicating that the hinged input mechanism is being depressed or released. The method further comprises, based on the received signal, determining, during a time interval, a rate of change of pressure detected at the pressure sensor and generating a control signal associated with the hinged input mechanism. The control signal comprises a velocity characteristic representative of the speed at which the hinged input mechanism is depressed or released, and the velocity characteristic of the control signal is based at least partly on the determined rate of change of pressure.

According to a further aspect of the present disclosure, a computer-readable medium comprising computer-executable instructions is disclosed. The computer-executable instructions, when executed by one or more computers, may cause the one or more computers to perform any of the methods disclosed herein.

According to a further aspect of the present disclosure, a computer system having a processor and memory is disclosed, wherein the memory comprises computer-executable instructions which, when executed, cause the computer to perform any of the methods disclosed herein.

BRIEF DESCRIPTION OF THE FIGURES

Illustrative implementations of the present disclosure will now be described, by way of example only, with reference to the drawings. In the drawings:

FIGS. 8*a* to 8*c* show a number of top-down views of exemplary pressure sensor arrangements for use in the control mechanism of the present disclosure;

Throughout the description and the drawings, like reference numerals refer to like features.

DETAILED DESCRIPTION

Figure 1:
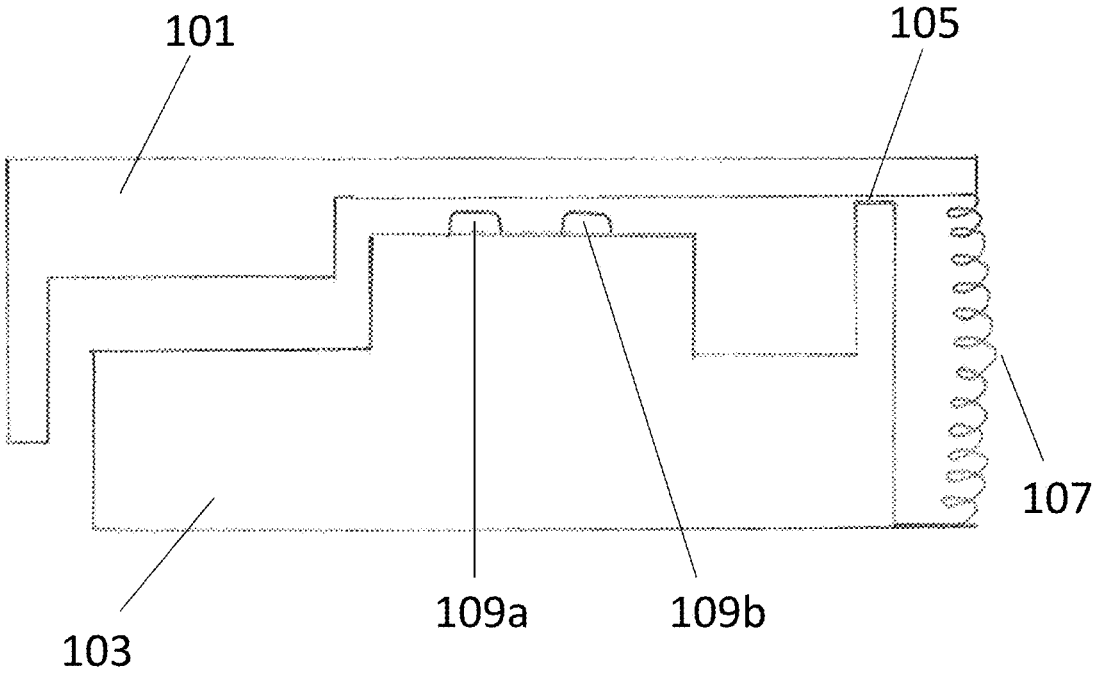
FIG. 1 shows a simplified schematic overview of a typical input mechanism of a traditional digital keyboard.

This detailed description describes, with reference to FIG. 1, a traditional control mechanism for controlling inputs through an input mechanism of a digital keyboard. The description then describes, with reference to FIGS. 2 to 10*d*, an alternative and improved control mechanism. The force to displacement behaviour of an exemplary arrangement of the control mechanism of the present disclosure is then described in relation to FIG. 11. An exemplary method for using the control mechanism of the present disclosure is described with reference to FIG. 12. Finally, with reference to FIG. 13, the components of a computer that can be used to implement the methods described herein are described.

The following detailed description will focus, for simplicity, on control mechanisms for generating audio control signals when provided in a digital keyboard. However, it will be appreciated that the disclosed methods and mechanisms are not limited to use in digital keyboards, and are not limited to generating audio control signals. Rather, the methods and mechanisms described herein can be used to produce any suitable form of control signal and can accordingly be accommodated in devices in any suitable field not limited to audio or music devices.

Further, the following detailed description will focus, for simplicity, on implementations where the hinged input mechanism(s) are hinged key(s), such as the keys of a digital keyboard. Again, however, it will be appreciated that the disclosed methods and mechanisms are not limited to using keys, and the input mechanism may comprise any suitable button or other input mechanism for receiving input forces.

Turning now to FIG. 1, a schematic overview of a typical key mechanism of a traditional digital keyboard is shown. The key mechanism, and indeed the digital keyboard as a whole, can be considered as a controller for producing audio control signals. The key mechanism comprises a key 101 which can be depressed by a user. The key is provided over a key bed 103. Typically multiple keys are provided, each having the same mechanism. For example, in a full sized digital keyboard 88 keys are provided in total (52 "white" keys and 36 "black" keys).

In use, the key 101 is depressed by a user. Typically the input force is provided towards the front end of the key. This force causes the key 101 to pivot about a pivot point 105 which is provided towards the rear end of the key 101. The mechanism shown in FIG. 1 is highly simplified, and the pivoting mechanism is typically more complex than that shown. Nevertheless, whatever the precise pivoting mechanism, on being depressed the base of the key moves downwards and contacts two or more switches. Two switches 109*a*, 109*b* are shown in the arrangement of FIG. 1, however more than two switches can be provided. A returning mechanism is provided and provides a returning force to return the key 101 to a rest position once the force from the user is removed, in other words when the user stops playing the key 101. The returning mechanism shown in FIG. 1 comprises a spring 107 provided towards the rear of the key 101. Again, this returning mechanism is highly simplified and is typically more complex than that shown.

On being activated by the key depression, the switches 109*a*, 109*b* provided beneath the key 101 send a signal to a processor. Responsive to this, the processor generates an audio control signal associated with the key 101 that has been depressed. This audio control signal is then used to generate an audio signal (a sound) at a loudspeaker. The loudspeaker can be provided as part of the digital keyboard or as a separate element to which the audio control signal is sent. When the user releases the key 101, the switches 109*a*, 109*b* are deactivated. From this, the processor can determine to stop generating the audio control signal. As a result, the sound produced at the loudspeaker ceases.

Where more than one key is provided, each key is typically associated with an individual sound, such as an individual note. The audio control signal produced on depression of each key is typically unique to that key, such that each key of the digital keyboard produces a unique sound or note when depressed. Thus configured, the digital keyboard is able to reproduce the functionality of a traditional string and hammer-based piano. Due to the digital nature of the digital keyboard, however, the sounds produced by the keys of the digital keyboard can be varied to a far greater degree than is possible when using a traditional piano. For example, the keys of the digital keyboard can be configured to produce sounds that are not typical of a traditional piano, such as string, brass, woodwind and percussion sounds.

The audio control signal produced in response to a key of a digital keyboard being depressed or released typically comprises a velocity characteristic representative of the speed at which the key is depressed or released. For example, where the digital keyboard is a MIDI keyboard, the audio control signals produced will be MIDI signals or "MIDI events" which comprise a velocity instruction. The velocity characteristic or instruction will impact one or more qualities to the audio signal (sound) eventually produced based on the audio control signal. An audio control signal with a velocity characteristic indicative of a high velocity typically produces a sharper, harsher sound than an audio control signal with a velocity characteristic indicative of a low velocity. The velocity of a sound is typically also correlated with the "attack" of the sound, which refers to how quickly the sound is initiated or recedes.

In traditional digital keyboards, the velocity characteristic of a sound associated with a particular key is determined based on the time difference between when the two or more switches provided beneath the key detect the depression or release of the key. For example, in the arrangement of FIG. 1, switch 109*a* will be activated slightly before switch 109*b* as the key 101 is depressed. If the key 101 is pressed with high velocity, then the time difference between the two switches 109*a*, 109*b* being activated will be relatively small. The velocity characteristic of the generated audio control signal will reflect this, and will produce an audio signal with properties characteristic of a high-velocity note input (e.g. increased attack, harshness and/or volume). On the other hand, if the key 101 is pressed with low velocity, then the time difference between the two switches 109*a*, 109*b* being activated will be relatively large. The velocity characteristic of the generated audio control signal will similarly reflect this, and will produce an audio signal with properties characteristic of a low-velocity note input (e.g. reduced attack, harshness and/or volume).

The same effect will occur during release of the key 101. In this case, switch 109*a* will detect the release before switch 109*b*. The difference in time between the two switches 109*a*,109*b* detecting the release of the key 101 will impact the velocity characteristic of the audio control signal produced, which will in turn determine the manner in which the sound decays as the key is released. Where the key 101 is released suddenly (i.e. with high velocity), the time difference will be small and the velocity characteristic of the audio control signal will reflect a high velocity. This will result in the sound ending abruptly. The opposite will hold if the key 101 is released slowly.

While traditional digital keyboards of the sort described above in reference to FIG. 1 clearly provide advantages over traditional pianos in terms of the versatility of the sounds they can produce, traditional digital keyboards nevertheless suffer from a variety of shortcomings. In particular, key mechanisms of the sort described in FIG. 1 require two or more switches to be provided beneath the key so that the velocity characteristic of the sound being played can be determined. This results in more complex circuitry and computational processing than would be required if only one activation mechanism were provided beneath each key. Having to rely on two switches also increases the chances that wear impacts the functioning of the mechanism, because there are two or more components that can fail. This effect is accentuated by the fact that the two or more switches may wear out at different rates due to the different forces applied to each of them. For example, in the arrangement of FIG. 1 switch 109*a* may wear out faster than switch 109*b* as a result of receiving increased input forces and being depressed by a greater extent relative to movement of the key 101.

Further drawbacks of the traditional digital keyboard arrangement of the sort shown in FIG. 1 include the fact that aftertouch functionality is typically minimal or is not provided at all. Aftertouch typically controls characteristics of the sound such as vibrato, volume, and other parameters such as pitch bending. Most digital keyboards provide no aftertouch functionality at all. Some digital keyboards do provide aftertouch functionality, but require knobs, faders or similar controls external to the keys of the keyboard themselves to be activated. However the operation of external controls such as knobs or faders is distracting and can detract from the user's ability to properly operate the device. Such digital keyboards typically also only provide monophonic aftertouch, which affects all keys of the keyboard equally at the same time. This severely limits the expressive range of the device.

A third key drawback of traditional digital keyboards of the sort shown in FIG. 1 is that they employ a complex pivoting and returning mechanism to ensure proper interfacing between the keys and the plurality of switches provided beneath them. As already mentioned, the mechanism shown in FIG. 1 is schematic and employs a simple pivot point 105 and a spring 107. However, this picture is highly simplified and in reality the mechanism for allowing the key 101 to pivot properly and interface with the switches 109*a*, 109*b* correctly to enable accurate velocity calculation is highly complex. The mechanism typically involves multiple moving elements which can easily fall out of alignment or wear, leading to keys that feel "sticky" or unresponsive or that in some cases may even become inoperable. Additionally, the complexity of the key pivoting mechanism typically leads to the mechanism being expensive to manufacture and install, which in turn raises the price of the digital keyboard itself.

The following disclosure sets out innovative alternative control mechanisms and associated processing methods. The disclosed mechanisms and methods can be employed in a digital keyboard to overcome the drawbacks of existing digital keyboards described above, as well as other drawbacks present in existing digital keyboards and controllers in general.

Figure 2:
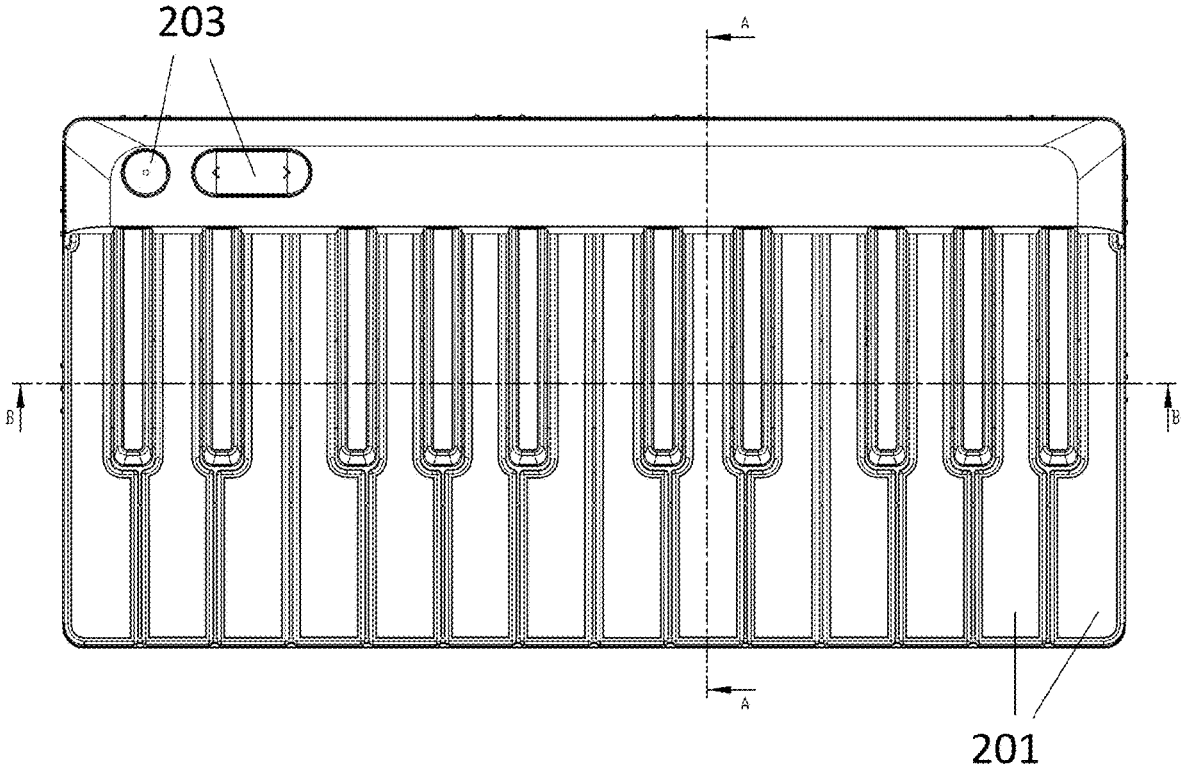
FIG. 2 shows a top-down view of an exemplary digital keyboard comprising a modified control mechanism for producing audio control signals according to the present disclosure.

FIG. 2 shows a top-down view of an exemplary digital keyboard comprising a modified control mechanism for producing audio control signals. This arrangement shown is merely an exemplary implementation and the disclosed mechanisms and methods can be employed to generate control signals that are not audio control signals and can be provided in isolation or incorporated into devices other than digital keyboards.

The keyboard of FIG. 2 comprises a plurality of keys 201. The keys 201 are hinged, in this example back-hinged, meaning that they are fixed at their rear end to the body of the keyboard. On being depressed, rather than pivoting the keys 201 simply bend while remaining substantially fixed at the hinge point. Accordingly, no complex mechanisms need to be employed to enable pivoting of the keys 201 on depression of the keys 201, in contrast to most existing digital keyboards. Instead, each key 201 is configured to bend in response to a force being applied to the front end of the key 201. By using hinged keys and avoiding the need for a complex pivoting system, the complexity and manufacturing cost of the device is reduced.

To enable the hinged keys 201 to bend, the hinged keys 201 are made of a material that is resilient and is able to flex when the keys 201 are pressed and return to their original position when the pressure on the keys 201 is removed. In this example the keys 201 are made of a rigid plastic material, such as Polycarbonate (PC), Acrylonitrile butadiene styrene (ABS), Polypropylene (PP) or a mixture of a plurality of types of thermoplastic materials. Other materials of varying rigidity may be used. The thickness of the keys 201 at least partly determines their flexibility, and is selected such that the keys bend to an appropriate extent when depressed by a user. Various controls 203, such as a power button and a volume control, are provided on the keyboard in this exemplary arrangement, however these can be omitted in other arrangements.

Figure 3A:
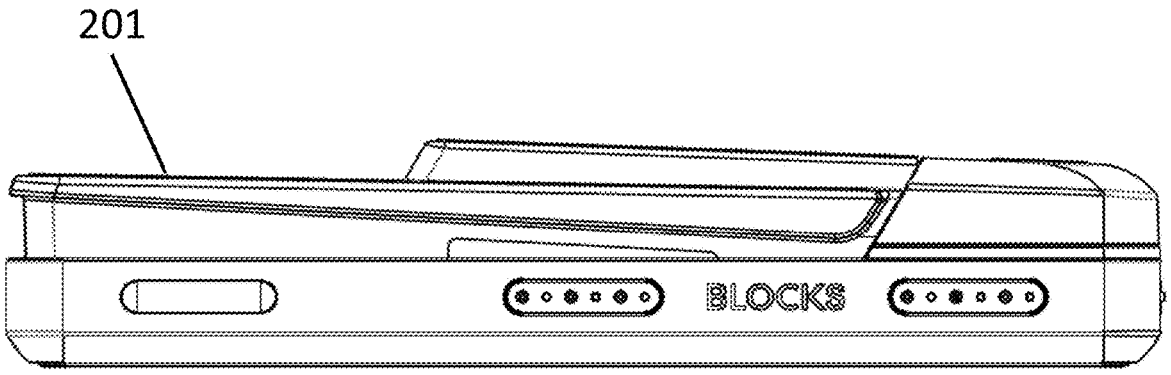
FIGS. 3*a* and 3*b* show a side-view of the digital keyboard of FIG. 2.
Figure 3B:
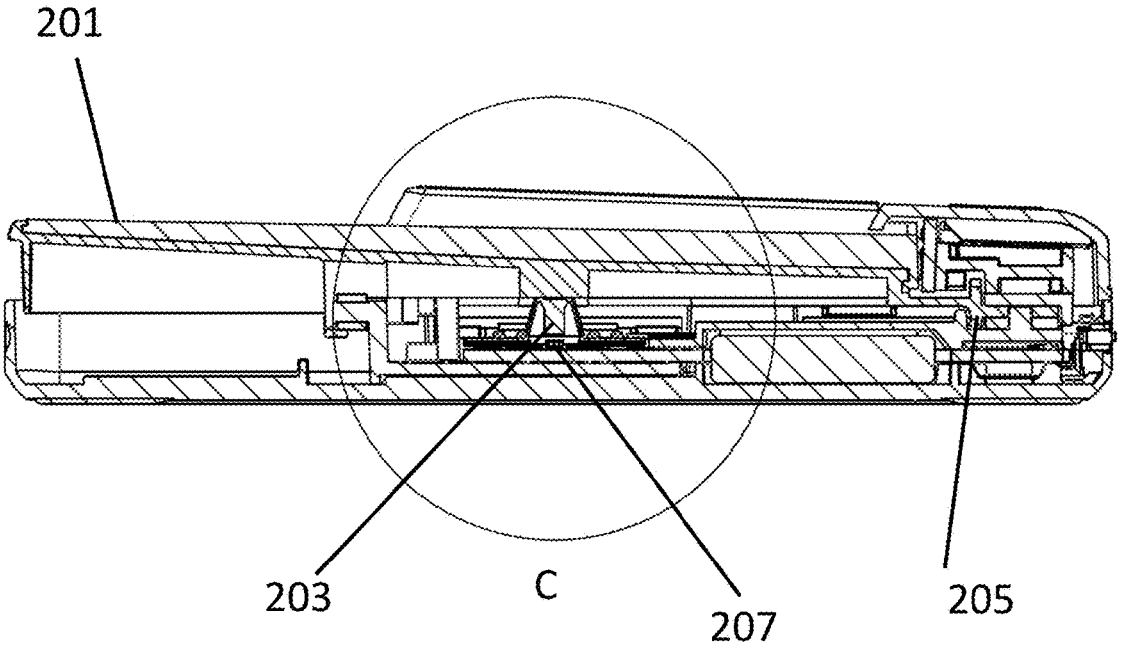

Turning to FIGS. 3*a* and 3*b*, a side-view of the digital keyboard of FIG. 2 is shown. The viewing direction corresponds to the direction indicated by the arrows and axis labelled with the letter "A" in FIG. 2. FIG. 3*a* shows an ordinary view of the side of the digital keyboard, whereas FIG. 3*b* shows a cross-sectional view from the same direction but with the side of the keyboard removed so that the inner workings of the keyboard are visible. The area of FIG. 3*b* enclosed by the circle labelled with the letter "C" will be described in more detail in relation to FIG. 5.

As previously mentioned, and as can now be seen more clearly in FIG. 3*b*, the key 201 is back-hinged, meaning that it is fixed at a hinge point 205 towards its rear. This fixed hinge point 205 acts as a pivot point about which the key 201 bends when a force is applied, in particular when a force is applied to the front of the key 201. No complex pivoting mechanism is required, rather the key 201 simply bends as a result of the pressure applied and the resilient but flexible nature of the material used to form the key 201.

As can also be seen from FIG. 3*b*, a single force direction element 203 is provided beneath each key 201. When the key 201 is depressed, the key impacts the force direction element 203 and depresses the force direction element towards a pressure sensor 207 provided beneath the force direction element 203. The depression of the key 201 can thereby be detected by the pressure sensor 207, as will be described in more detail below.

By utilising only a single force direction element 203 and sensor 207 provided beneath each key, the complexity of the key mechanism is reduced. In particular, only one force direction element 203 and sensor per key needs to be manufactured and installed. This reduces the number of components used in the device, and so reduces the number of components that are susceptible to wear and damage. Further, by using a single force direction element and a pressure sensor 207 rather than two switches, the risk of a plurality of switches or force direction elements wearing out at different rates and thereby providing inaccurate readings is removed. Reducing the number of components also reduces the cost of manufacturing the device.

Figure 4A:
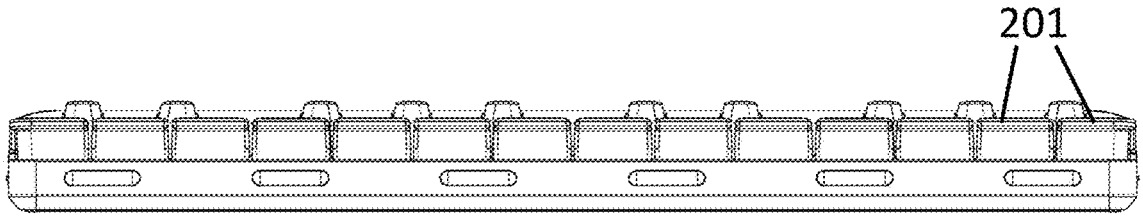
FIGS. 4*a* and 4*b* show a front-view of the digital keyboard of FIG. 2.
Figure 4B:
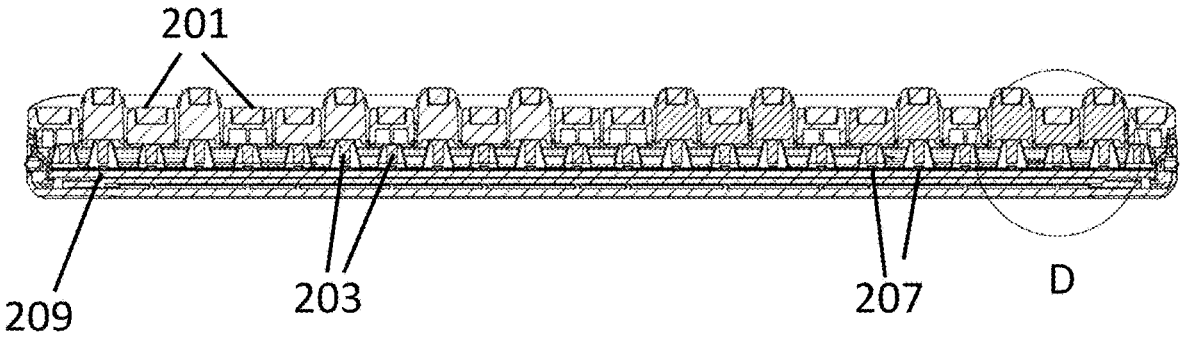

Turning to FIGS. 4*a* and 4*b*, a front-view of the digital keyboard of FIG. 2 is shown. The viewing direction corresponds to the direction indicated by the arrows and axis labelled with the letter "B" in FIG. 2. FIG. 4*a* shows an ordinary view of the front of the digital keyboard, whereas FIG. 4*b* shows a cross-sectional view from the same direction but with the front of the keyboard removed so that the inner workings of the keyboard are visible. The area of FIG. 4*b* enclosed by the circle labelled with the letter "D" will be described in more detail in relation to FIG. 6.

As in FIG. 3*b*, FIG. 4*b* shows a single force direction element 203 provided between each key 201, and corresponding pressure sensor 207. In this arrangement each pressure sensor 207 is provided on a printed circuit board, PCB, 209. Other sensor arrangements may be utilised and will be apparent to a person skilled in the art.

The disclosed control mechanism for generating control signals using the keys 201 will now be described in further detail with reference to FIGS. 5 to 7.

Figure 5:
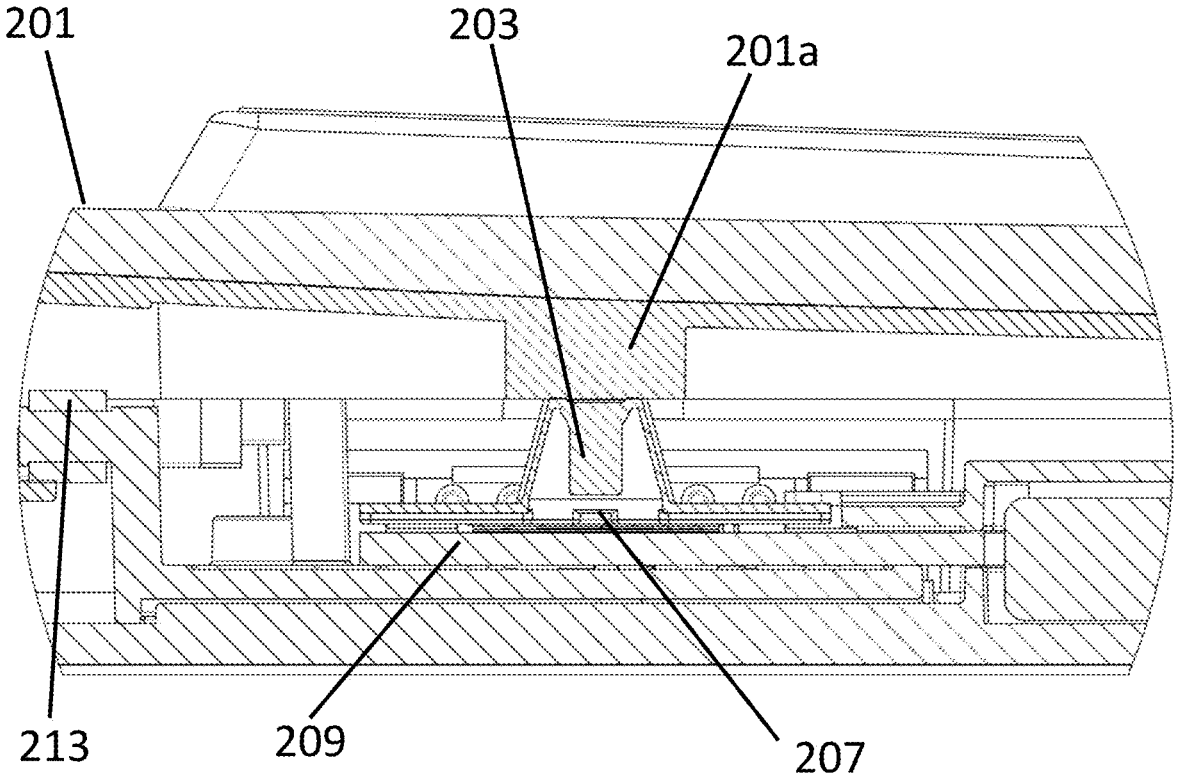
FIG. 5 shows a close up view of the area enclosed by the circle marked with the letter "C" in FIG. 3*b;*
Figure 6:
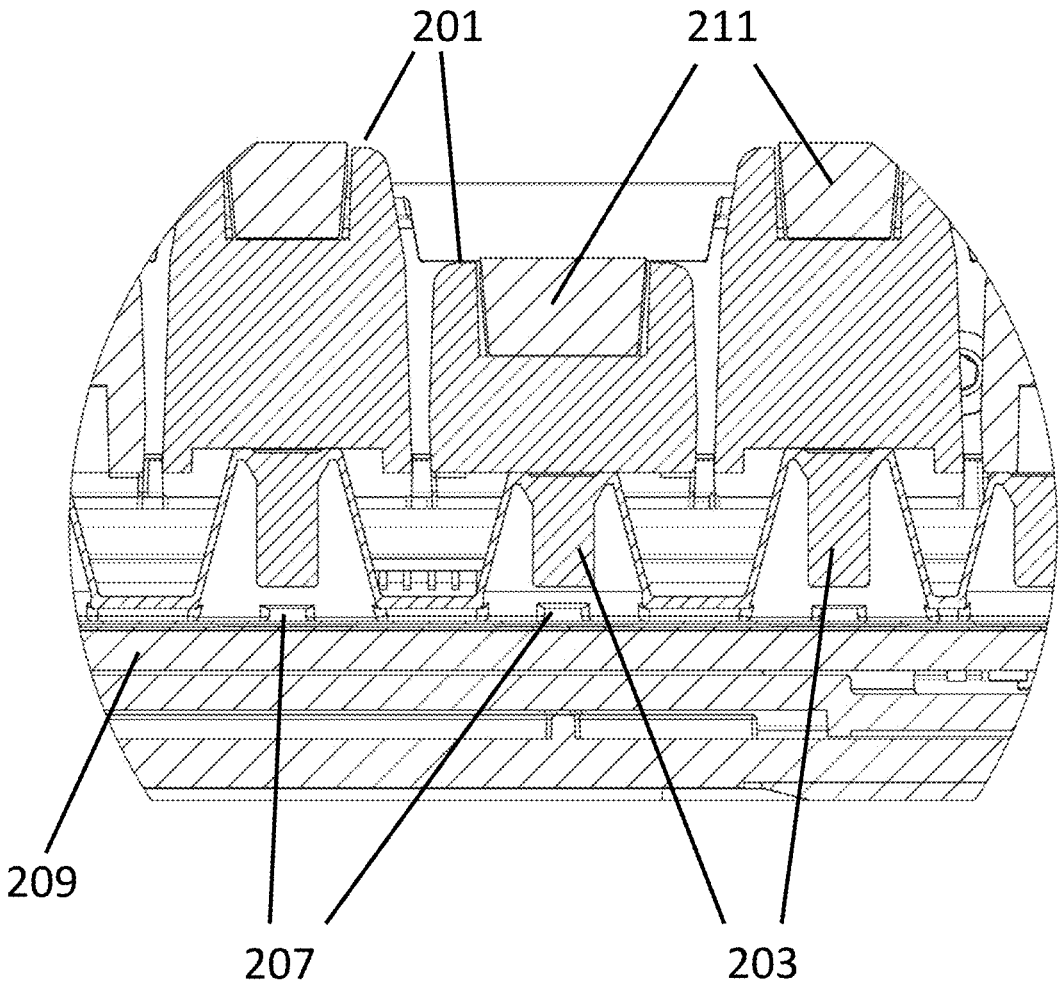
FIG. 6 shows a close up view of the area enclosed by the circle marked with the letter "D" in FIG. 4*b;*

FIGS. 5 and 6 both show in more detail the key mechanism introduced in relation to FIGS. 2 to 4*b*. As previously described, a plurality of hinged keys 201 are provided. A pressure sensor 207 is provided beneath each hinged key. A processor (not shown) is provided in the digital keyboard and is configured to receive a signal from each pressure sensor 207 (via a PCB 209) indicating that a respective hinged key 201 is being depressed or released. On receiving the signal, the processor is configured to generate an audio control signal associated with the key 201 in question.

A force direction element 203 is provided between each key 201 and its respective pressure sensor 207. As previously mentioned, in this exemplary arrangement a single force direction element 203 and a single sensor 207 are provided for each key so as to simplify the mechanism. Other arrangements comprising more than one force direction element 203 and/or sensor 207 are possible, however. As can be seen from FIG. 5, in this exemplary arrangement the base of each key 201 comprises a portion 201*a* that extends outward from the base of the key 201 and is aligned with the force direction element 203 and is arranged such that, on depression of the key 201, the portion 201*a* of the key 201 contacts the force direction element 203. Other arrangements are possible, for example the extending portion 201*a* may be omitted.

In this exemplary arrangement the force direction element 203 is formed from a compressible elastic material, such as silicone, although other materials can be used. On being contacted by the key 201, the force direction element 203 is depressed onto the pressure sensor 207 provided below it. The force applied to the key 201 is thereby transferred by the force direction element 203 to the sensor 207. Further depression of the key leads to an increased force being transmitted to the sensor 207. In this exemplary arrangement, further depression of the key also leads to compression of the elastic force direction element 203.

A benefit of providing a force direction element 203 formed of an elastic, or resilient material is that it provides a returning force on the key 201 when the key is depressed and the force direction element 203 is compressed. This provides improved tactile feedback (also known as haptic feedback) to the user and enables more precise control of the key 201 during input, in particular in arrangements where the pushback force provided on the key 201 by the force direction element 203 increases as the key 201 is depressed further.

As can be seen in FIG. 5, a stopper 213 is provided underneath each key 201 in this exemplary arrangement. In this example, the stopper 213 is provided underneath the front end of the key 201, however alternative arrangements are possible. In this example, the stopper 213 is comprised of an elastic material, such as rubber, which is stiffer (more resistant to compression) than the material which comprises the force direction element 203. This means that the returning force exerted on the key by the stopper 213 increases more quickly than the returning force exerted on the key by the force direction element 203, relative to the downward movement of the key 201 during key depression. The provision of a stopper 213 extends the functionality of the device by enabling the key mechanism to provide at least three distinct feedback phases to the user during depression of the key 201, as will be described in greater detail in relation to FIG. 11.

As can be seen in FIG. 6, in this exemplary arrangement, each key 201 includes a lightguide portion 211 configured to allow light to pass through the key 201 during operation of the digital keyboard. A light source, such as an LED (not shown) may be provided beneath each key 201 to enable the keys to light up, individually or in unison.

Figure 7:
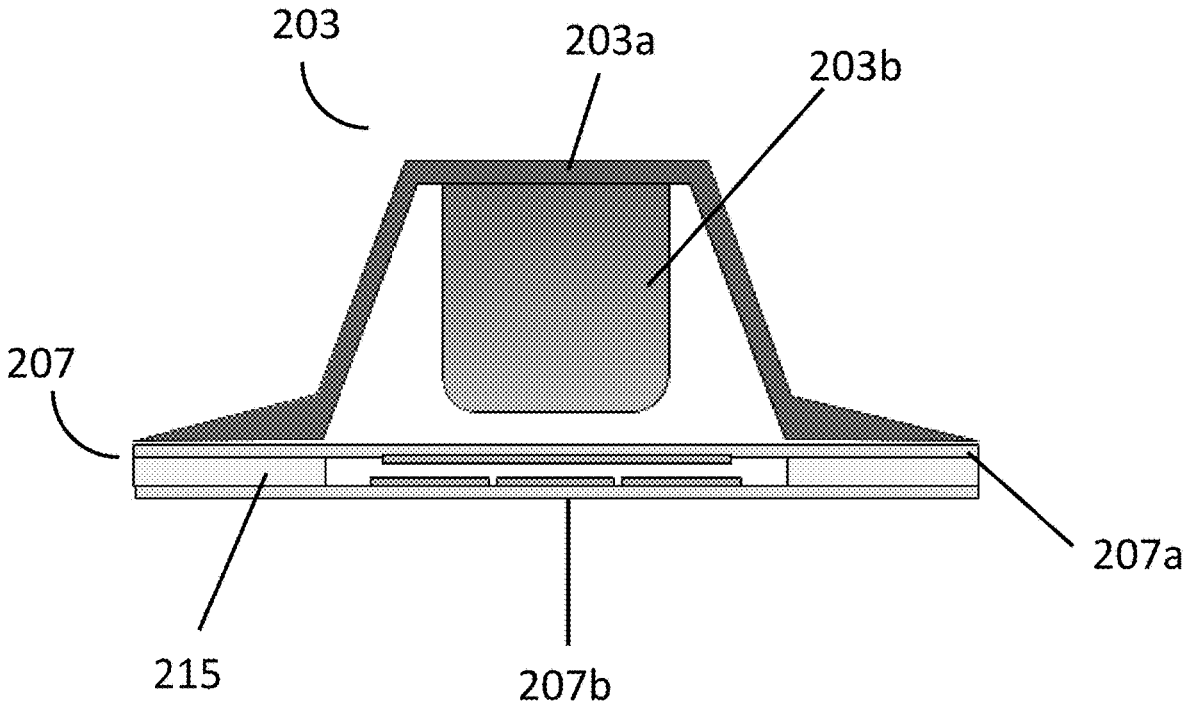
FIG. 7 is a schematic drawing of an exemplary force direction element and sensor arrangement for use in the control mechanism of the present disclosure.

Turning now to FIG. 7, a more detailed view of an exemplary force direction element 203 and sensor arrangement 207 for use in the control mechanism of the present disclosure is shown. In this arrangement the force direction element 203 comprises two main portions. The first portion 203*a* comprises an elastomer dome switch, while the second portion 203*b* comprises an elastomer pillar. The elastomer dome switch 203*a* is configured to bend under pressure exerted from above by a key 201 being depressed by a user. This flexing of the dome switch 203*a* pushes the pillar 203*b* downward onto a pressure sensor 207 provided beneath the pillar 203*b*. Further downward force then compresses the elastomer pillar 203*b*. Because both the dome switch 203*a* and pillar 203*b* are elastic in this arrangement, they each provide a returning force on the key 201 which resists depression of the key 201 and acts to return the key 201 towards its rest position. The dome switch 203*a* and pillar 203*b* thereby provide tactile feedback to the user during key depression.

A more detailed view of an exemplary sensor 207 for use in the control mechanism of the present disclosure is also shown in FIG. 7. In this exemplary arrangement, the sensor 207 provided beneath the force direction element 203 comprises a dual-membrane sensor having a first membrane 207*a* and a second membrane 207*b*. In this example the first membrane 207*a* is a top membrane and the second membrane 207*b* is a bottom membrane, when viewed in the reference frame of the keyboard in a normal playing position. The first and second membranes face one another and are flexible. The membranes are configured to come into contact when the sensor 207 is impacted by the force direction element 203, in this example the elastomer pillar 203*b* of the force direction element 203.

The pressure sensor 207 in this example works as follows. An input force transmitted from the key 201 towards the sensor 207 via the force direction element 203 forces the top flexible membrane 207*a* to bend towards the bottom flexible membrane 207*b*, such that one or more pairs of conductive features provided on the membranes contact. Contact between the conductive features closes a circuit though which a current can pass. The area of contact between the conductive features increases with an increased amount of input pressure applied to the key 201, and current flow scales with the area of contact. Thus, variations in current flow correlate with variations of input pressure by the user. This forms the basis of a pressure sensitive means for controlling a signal based on input to the key 201.

To prevent unintentional contact between the conductive features in this exemplary arrangement, the top flexible membrane 207*a* and the bottom flexible membrane 207*b* are separated by spacers 215. These spacers 215 also have the advantage of reducing noise by preventing mis-triggering and low-current leakage which may occur if the two flexible membranes were slightly in contact. The spacers also provide a reactive force to the user.

Turning now to FIGS. 8*a* to 8*c*, a number of top-down views of exemplary pressure sensor arrangements for providing under the keys of the present disclosure are shown. As described above, typically one pressure sensor is provided beneath each key, although more than one pressure sensor could be provided beneath each key. The pressure sensor arrangements shown in FIGS. 8*a* to 8*c* can be incorporated into pressure sensors of the type just described with reference to FIG. 7, as well as into other types of sensor.

Each pressure sensor 207 may comprise a substantially unitary surface, or may be split into a plurality of segments. Where the pressure sensor 207 comprises a first flexible membrane 207*a* and a second flexible membrane 207*b*, the electrical contacts on one or both membranes may be split to form the segments.

Each of the pressure sensors shown in FIGS. 8*a* to 8*c* comprises a plurality of segments. The sensor 207 shown in FIG. 8*a* comprises two segments, a left segment and a right segment (when viewed in the reference frame of the digital keyboard, viewed from a normal playing position). This means that the pressure sensor 207 can detect the force distribution across it in the X-plane (i.e. the left-to-right plane, from the perspective of a user playing the keyboard in a normal playing position). These variations in force distribution across the X-plane of the sensor 207 can be used to modify the audio control signal produced. For example, a user may roll or otherwise moves their finger from left to right while depressing a key 201. This motion can be detected by the sensor 207 of FIG. 8*a*, because the pressure detected at each segment of the sensor 207 will vary as a result of the motion. This motion can be converted into one or more modulation effects applied to the audio control signal. Such modifications may include pitch-bending, vibrato, volume modification, a filter control, the addition of a new sound type or instrument and/or the addition or modification of a rhythm effect. Other effects will be apparent to a person skilled in the art. The effects may be aftertouch effects and may only be provided once a threshold pressure is exceeded.

The sensor 207 shown in FIG. 8*b* also comprises two segments, however in this case the segments are a top segment and a bottom segment (when viewed in the reference frame of the digital keyboard viewed from a normal playing position). This means that the pressure sensor 207 can detect the force distribution across it in the Y-plane (i.e. the front-to-back plane, from the perspective of a user playing the keyboard in a normal playing position). As in the sensor of FIG. 8*a*, these variations in force distribution across the Y-plane of the sensor 207 can be used to modify the audio control signal produced in the same manner as the sensor 207 of FIG. 8*a*. In particular, the sensor of FIG. 8*b* may be used to detect whether a user is pressing the front end of a key 201 or the back end of a key 201 or is moving between these positions.

The sensor 207 provided beneath each key 201 may comprise any suitable number of segments (i.e. between one and N segments). For example, the sensor 207 could comprise a combination of the arrangements of FIGS. 8*a* and 8*b* and have four segments—a bottom left, bottom right, top left and top right segment. This arrangement would provide both X and Y plane modulation functionality, in other words would combine the functionality of the sensors of FIGS. 8*a* and 8*b* just described. Another exemplary arrangement along these lines is shown in FIG. 8*c*, where the sensor 207 comprises five segments—a central segment and four additional segments (top, right, bottom, left). It will be appreciated that, by varying the arrangement of sensor segments, the functionality of the key provided above the sensor can be varied and enhanced.

Where the sensor 207 comprises multiple segments, the processor of the device may be configured to interpolate a plurality of pressure data signals received from the pressure sensor 207 to derive a centroid location of the input to the pressure sensor across the plurality of segments.

As a result of providing sensors with multiple segments, an additional modality for providing modulations to the sounds produced is provided. The combination of this input modality in the X and/or Y plane of the key 201 with the versatile and varied input modality provided in the plane of depression of the key (which can be considered a Z plane of the key) enables a highly diverse range of inputs to be provided via the key 201 by the user. As a result, each key 201 of the digital keyboard may provide a range of functionality that is typically only provided by more complex devices that have departed from the traditional keyboard interface, such as complex synthesizers having various knobs and dials or having a uniform or non-key based input surface. By retaining the traditional keyboard interface, the device of the present disclosure enables complex sound combinations to be produced without complicating the input interface. In particular, most users are already familiar with the traditional keyboard interface. Thus, the device provides improved versatility without requiring the user to become familiar with a new input interface.

Figure 9A:
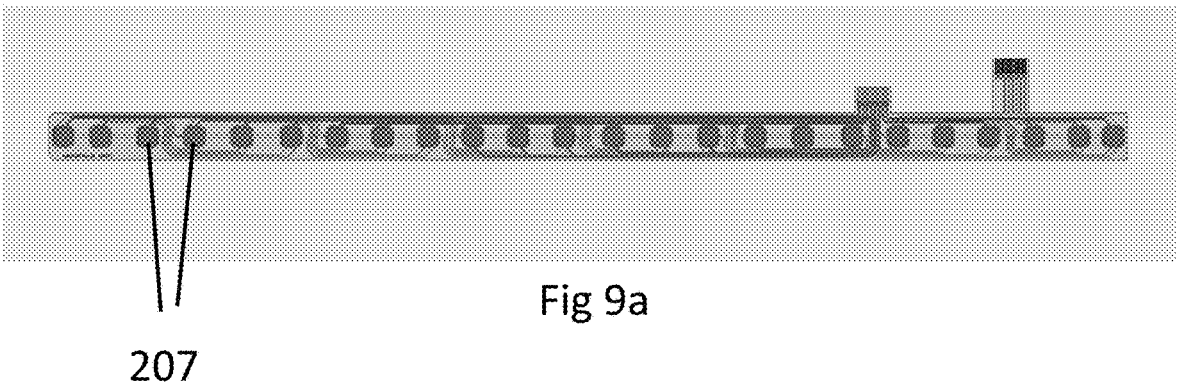
FIGS. 9*a* and 9*b* each show a pressure sensing component comprising a plurality of independent pressure sensors for providing under a plurality of input mechanisms of a digital keyboard.
Figure 9B:
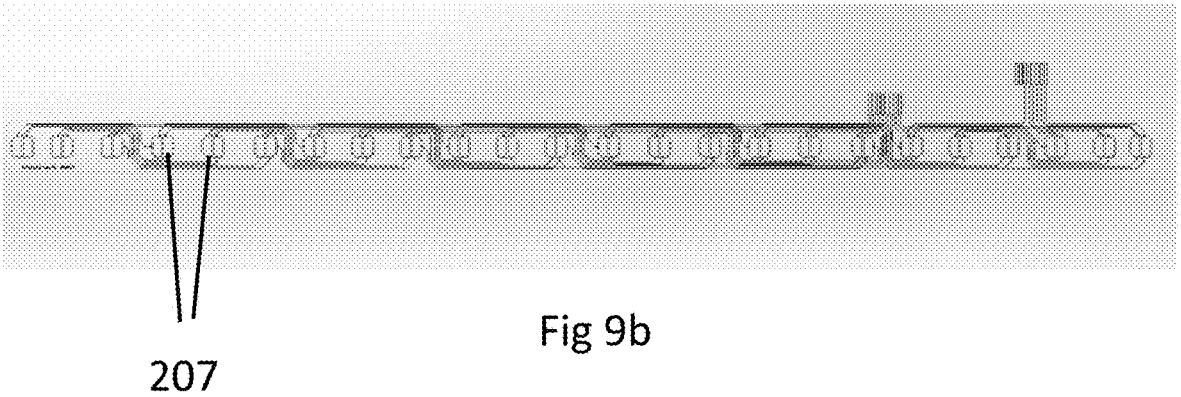
Figure 10A:
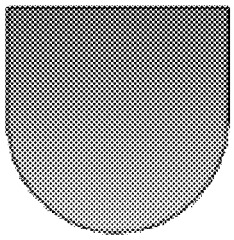
FIGS. 10*a* to 10*d* show a variety of potential exemplary shapes of the force direction element provided in the control mechanism of the present disclosure.
Figure 10B:
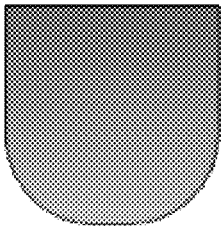
Figure 10C:
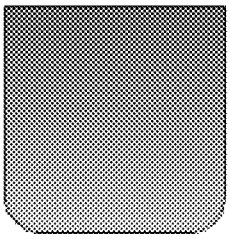
Figure 10D:
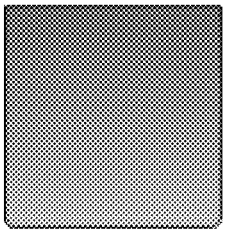

Turning now to FIGS. 9*a* and 9*b*, a pressure sensing component is shown comprising a plurality of pressure sensors 207. FIG. 9*a* shows a pressure sensing component comprising 24 independent pressure sensors 207 each having a substantially unitary surface, for providing under 24 respective keys 201 of a digital keyboard. FIG. 9*b* similarly shows a pressure sensing component comprising 24 independent pressure sensors for providing under 24 respective keys 201 of a digital keyboard, however in FIG. 9*b* each pressure sensor is divided into two segments (in this case a left and a right segment, in a similar manner as was described in relation to FIG. 8*a* above). It will be appreciated that the sensor arrangements of FIGS. 9*a* and 9*b* can incorporate as many independent pressure sensors as required. The arrangements can also be combined, in other words some pressure sensors may comprise multiple segments whereas some may have a substantially unitary surface. The pressure sensing component comprising the sensors is in this arrangement provided on a PCB, however other arrangements will be apparent to a person skilled in the art.

Turning now to FIGS. 10*a* to 10*d*, a variety of potential shapes of the force direction element 203 are shown. The shapes shown may be used for the elastomer pillar 203*b* described with reference to FIG. 7. Typically, the design of the tip of the force direction element 203 will depend on the type of pressure sensor arrangement used. For example, tips of the shape shown in FIGS. 10*a* and 10*b* may be more appropriate for use with a sensor 207 having a plurality of segments. This is because a tip having the shape shown in FIGS. 10*a* and 10*b* will initially contact a central segment of the pressure sensor. On the touch pressure increasing, for example in an attempt to induce aftertouch effects, the peripheral segments surrounding the centre segment will then be activated as well. Tips of the shape shown in FIGS. 10*c* and 10*d* may be more appropriate for use with a sensor 207 having a unitary surface, as tips of this shape ensure that the touch pressure is applied to the pressure sensor 207 consistently and there is less need for pressure to be applied to different segments at different stages of the key depression. The tip shape should preferably be optimised to take into account the sensitivity and range requirements of any modulation functionalities provided, as well as the pressure segment layout underneath and the material hardness and diameter of the force direction element 203.

A variety of exemplary arrangements for the control mechanism of the present disclosure have been described with reference to FIGS. 2 to 10*d*. The behaviour of an exemplary arrangement of the mechanism of the present disclosure during key depression and release will now be described in relation to FIG. 11.

Figure 11:
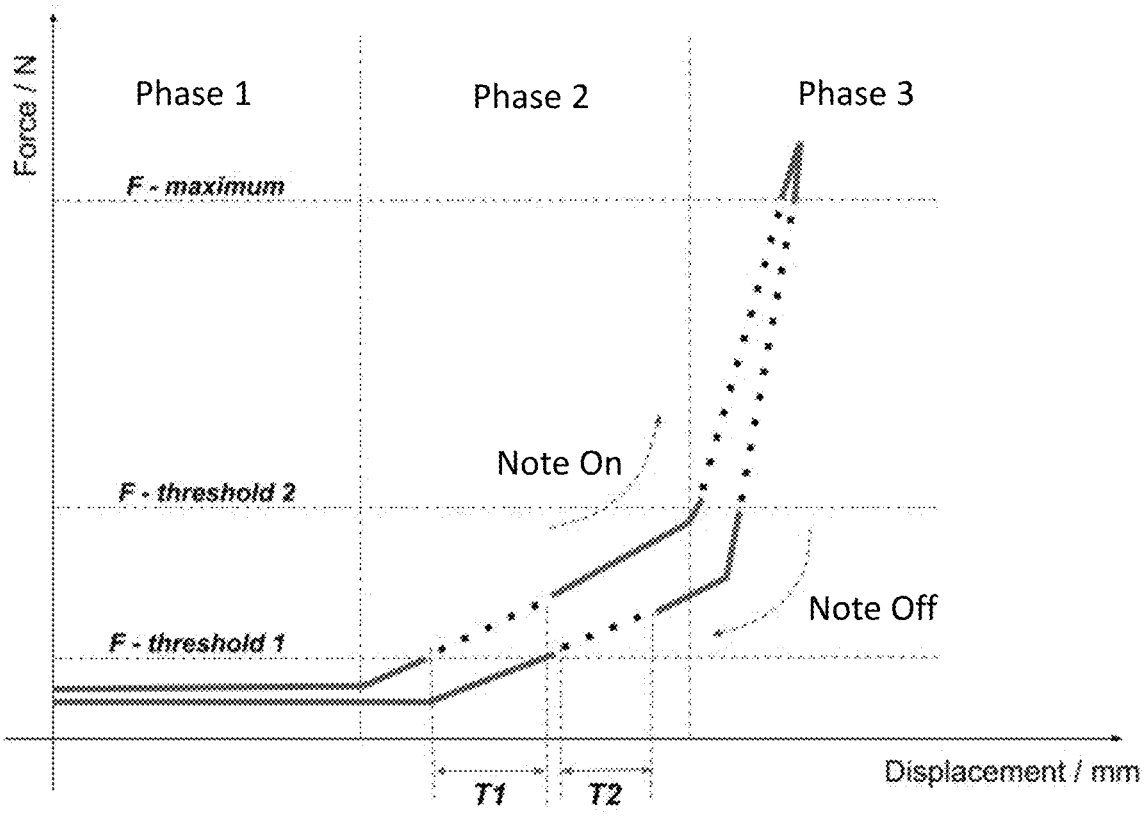
FIG. 11 shows the force to displacement behaviour of an exemplary arrangement of the control mechanism of the present disclosure, during depression and release of an input mechanism.

FIG. 11 shows the returning force provided by the key mechanism to the user during depression and release of the key 201, relative to the downward displacement of the key. It will be appreciated that the returning force provided to the user by the key 201 is equal to the force provided on the key (and thus indirectly to the pressure sensor 207 underneath the key) by the user, as a result of Newton's third law.

The depression of a key 201 and initiation of an associated sound will be described as a "Note-On" event in relation to FIG. 11. Similarly the release of a key 201 and ending of the associated sound will be described as a "Note-Off" event. While the term "note" is used for simplicity, it will be appreciated that the mechanism and methods described can relate more generally to "sounds" that do not have to be notes. Furthermore, in this exemplary arrangement the audio control signals produced are MIDI signals, however other audio control signals can be used.

As mentioned above in relation to FIG. 5, the provision of a hinged key 201, a compressible force direction element 203 and compressible stopper 213 enables the key mechanism of the present disclosure to provide at least three distinct tactile feedback phases to the user during depression of the key 201. These three distinct phases are indicated in FIG. 11 and correspond to regions of specific force/displacement behaviour as will now be explained.

During a first phase of key depression during a Note-On event, before the key 201 comes into contact with the force direction element 203 or the stopper 213, the key 201 is effectively in free-fall. During this phase the only returning force provided by the key mechanism results from the elasticity or resilience of the key 201 itself. During this first phase the returning force remains relatively constant as the key 201 is depressed further, as can be seen from the shape of the Note-On curve of FIG. 11 during the first phase. This is because the free-fall distance is relatively short, and the key 201 is engineered to provide a relatively constant returning force during this phase. In other arrangements the returning force provided by the key 201 may increase during the first phase relative to displacement of the key 201.

Once the key 201 comes into contact with the force direction element 203, the force relative to further downward displacement of the key 201 begins to increase as the force direction element 203 begins to provide its own returning force on the key 201. The pressure detected at the pressure sensor 207 also increases accordingly. A note initiation threshold can be set, and is labelled as "F-threshold 1" in FIG. 11. Once this threshold is reached, the pressure sensor 207 underneath the key 201 detects a corresponding pressure threshold being reached. At this point, the second phase of the depression action begins and the processor generates an audio control signal for the key. Generating the audio control signal includes determining a velocity characteristic of the signal, as will be described in further detail below.

During the second phase, further depression of the key 201 compresses the force direction element 203 as described in relation to FIG. 7 above. As a result of this compression and the elastic nature of the force direction element 203, the force direction element 203 provides its own returning force on the key 201. Thus, during the second phase the total returning force comprises that provided by the key 201 itself and the force direction element 203. As the key 201 is further depressed, the force direction element 203 is increasingly compressed and, due to its elastic nature, provides an increasingly large returning force on the key 203. During this second phase, the returning force therefore increases as the key 201 is depressed further, as is apparent from the shape of the Note-On curve of FIG. 11 during the second phase.

As described above, at some point during the depression of the key 201 the key will come into contact with the stopper 213. This will typically lead to a rapid increase in force relative to further downward displacement of the key 201, due to the rigidity of the stopper 213. An aftertouch force threshold can be set, and is labelled as "F-threshold 2" in FIG. 11. Once this threshold is reached, the pressure sensor 207 underneath the key 201 will detect a corresponding pressure threshold being reached. This marks the beginning of the third phase of the depression action. At this point, the processor of the present exemplary arrangement is configured to apply aftertouch effects to the audio control signal it is generating for the key. For example, the processor may apply a pitch-bending effect, a vibrato effect, a modified volume effect, a modified timbre effect, a modified rhythmic effect or may apply an additional sound type to the control signal. A spatial effect such as a delay, reverb and/or panning effect may also be applied. Any other suitable digital aftertouch modulation or manipulation may be applied to the signal. There may be more than one aftertouch threshold, with each aftertouch threshold being associated with the initiation of a new aftertouch effect. Various aftertouch effects may thereby be layered onto one another or may replace one another as an increasing number of aftertouch pressure thresholds are exceeded.

The modification of the signal may be constant as long as the pressure detected at the pressure sensor is above the aftertouch threshold. Alternatively, the modification of the signal may be variable and vary when the pressure detected at the pressure sensor changes but remains above the first threshold. In other words the modification of the signal may vary based on how far the aftertouch threshold is exceeded in absolute terms. The modification of the signal may alternatively vary based on the rate of change of the pressure above the threshold. In one example, an aftertouch effect begins once the aftertouch threshold is exceeded and then increases or otherwise changes as the pressure is increased further and further beyond the aftertouch threshold. Similarly, the aftertouch effect may reduce or otherwise change as the pressure reduces and comes closer again to the aftertouch threshold, until the pressure drops below the aftertouch threshold at which point the after touch effect typically ceases.

The aftertouch modification may involve adding a brand new effect or component to the audio control signal or may comprise modifying a component of the signal that was already present. For example, where the aftertouch effect relates to the incorporation of a vibrato effect, this is typically a new component added to the audio control signal. On the other hand, where the aftertouch effect relates to a pitch bend effect or a volume change effect, this is typically achieved by modulating a property already inherent in the control system, for example a pitch or volume component.

As described above, the third key depression phase (which can be considered an aftertouch phase in the present example where the third phase is associated with aftertouch effects) is also associated with a unique tactile feel resulting from the increased returning force on the key 201 during this phase. This provides the user with an intuitive and responsive playing experience. Thus, the third phase of the key depression extends the functionality of the device in musical terms (because aftertouch effects can be applied to the produced sounds, extending the range of expression of the device) and also extends the functionality of the device in terms of providing an improved man-machine interface (because aftertouch effects and the third phase in general are associated with an intuitive and precise tactile input experience).

In the present exemplary arrangement there are a plurality of keys 201 and the processor is configured to generate an individual audio control signal with individual aftertouch characteristics for each respective key 201. The audio control signal and associated aftertouch characteristics for each respective key 201 are independent of the audio control signal and associated aftertouch characteristics for each other key 201. The processor in the present arrangement is also configured to generate more than one individual audio control signal with individual aftertouch characteristics concurrently. In other words, multiple keys 201 can be depressed at the same time, and aftertouch effects can be applied independently to each depressed key such that each key can have its own unique aftertouch effects based on how hard that particular key is being depressed at a given time, regardless of what is happening at any other key. Polyphonic aftertouch functionality is thus provided, with each key 201 benefiting individually from the functionality described in relation to FIG. 11.

As well as the Note-On curve associated with depression of the key 201, FIG. 11 also shows the Note-Off curve associated with release of the key 201. There may be a certain level of hysteresis, so the relaxation (Note-Off) curve does not necessarily overlap with the compression (Note-On) curve, as shown in FIG. 11. As is apparent from FIG. 11, the Note-Off functionality is the same as the Note-On functionality, only in reverse. In other words, as the force on the key is reduced, the depression action moves from the third phase to the second, and from the second to the first. Once the force falls below the aftertouch threshold ("F-threshold 2"), aftertouch effects cease. Once the force falls below the note initiation threshold ("F-threshold 1"), the note ends.

As noted above, the force/displacement characteristics of the disclosed mechanism can be used to provide an innovative and simplified method of calculating a velocity characteristic of the audio control signal during Note-On and Note-Off. This will now be described.

As mentioned in relation to FIG. 11, at some point during depression of the key 201, the returning force on the key 201 will reach a note initiation threshold ("F-threshold 1" in FIG. 11). At this point, the pressure detected at the pressure sensor 207 beneath the key 201 will also have reached a corresponding threshold as a result of Newton's third law.

Responsive to this, the processor of the device in the present exemplary arrangement is configured to determine, during a pre-determined time interval after the note initiation threshold has been exceeded, the rate of change of pressure detected at the pressure sensor. A velocity characteristic of the control signal is then based on this determined rate of change of pressure. The time interval during which the velocity calculation takes place is indicated relative to the Note-On force/displacement curve of FIG. 11 and is marked as "T1".

In mathematical terms, the velocity characteristic of the audio control signal is determined by:

$$V_{ON} = \frac{P_1 - P_0}{t_1 - t_0} = \frac{\Delta P_1}{T1}$$

where $V_{ON}$ is the velocity characteristic of the Note-On event signal (i.e. of the audio control signal caused by depression of the key 201), $t_0$ is the time at which the first pressure sensor reading for the Note-On velocity calculation is made, $t_1$ is the time at which the final pressure sensor reading for the Note-On velocity calculation is made, $P_1$ is the pressure reading at the pressure sensor 207 at time $t_1$ and $P_0$ is the pressure reading at the pressure sensor 207 at time $t_0$. The time period T1 is therefore equal to $t_1-t_0$ and $\Delta P_1$, i.e. the change in pressure over time interval T1, is equal to $P_1-P_0$.

The velocity characteristic of the Note-On event signal will determine how quickly or harshly the note (or sound) produced by the depression of the key 201 is initiated. A rapid depression of the key 201 will lead to a relatively large change in pressure, $\Delta P_1$, over time interval T1. This will typically lead to an abrupt initiation of the sound associated with the key 201. Alternatively, a slow or gentle depression of the key 201 will lead to a relatively small change in pressure, $\Delta P_1$, over time interval T1. This will typically lead to a more gradual initiation of the sound associated with the key 201.

It will be apparent that an equivalent but reversed calculation can be made for determining the velocity characteristic of a Note-OFF event signal (i.e. of the audio control signal caused by release of the key 201). This calculation is performed in a similar manner during the release of the key and is therefore associated with the relaxation curve shown in FIG. 11. The time interval during which this Note-Off velocity calculation takes place is indicated relative to the Note-Off force/displacement curve of FIG. 11 and is marked as "T2".

For the Note-OFF calculation, the velocity characteristic of the audio control signal is determined by:

$$V_{OFF} = \frac{P_3 - P_2}{t_3 - t_2} = \frac{\Delta P_2}{T2}$$

where $V_{OFF}$ is the velocity characteristic of the Note-OFF event, $t_2$ is the time at which the first pressure sensor reading for the Note-OFF velocity calculation is made, $t_3$ is the time at which the final pressure sensor reading for the Note-OFF velocity calculation is made, $P_2$ is the pressure reading at the pressure sensor 207 at time $t_2$ and $P_3$ is the pressure reading at the pressure sensor 207 at time $t_3$. T2 is the time interval during which the Note-Off velocity calculation is performed and is therefore equal to $t_3-t_2$. $\Delta P_2$ i.e. the change in pressure over time interval T2, is equal to $P_3-P_2$.

The velocity characteristic of the Note-Off event will determine how quickly or harshly the note (or sound) ends. A rapid release of the key 201 will lead to a relatively large change in pressure, $\Delta P_2$, over time interval T2. This will typically lead to an abrupt end to the sound associated with the key 201. Alternatively, a slow or gentle release of the key 201 will lead to a relatively small change in pressure, $\Delta P_2$, over time interval T2. This will typically lead to a more gradual fading of the sound associated with the key 201.

It will be apparent that the various parameters involved in the velocity characteristic calculation can be pre-determined by the user or at manufacture, depending on the desired functionality. The exact manner in which the rate of change of pressure impacts the characteristics of the audio signal may differ depending on configuration of the device, either at manufacture or by the user. The time intervals T1 and T2 over which the velocity calculations are performed can be determined at manufacture or can be based on user preference. Similarly, the various pressure thresholds and times at which pressure readings are taken can be determined based on the requirements of the device or user at a given situation, or can be pre-determined at manufacture. The precise manner in which the calculated velocity characteristics are affected by the pressure changes can also vary based on the requirements of a given situation, user or device. In other words, what constitutes a "large" or a "small" increase or decrease in pressure over the time interval can depend on the way in which the device is set up and the needs of the user.

As can be seen, an innovative method and associated mechanism for determining a velocity characteristic of an audio control signal are provided. The method enables the key mechanism to only require a single pressure sensor and force direction element. This is in contrast to existing key mechanisms wherein at least two pressure sensors need to be provided in order to calculate a velocity characteristic of an audio control signal, as was described in relation to FIG. 1 above. Accordingly, the disadvantages of relying on multiple switches to calculate the velocity characteristic, described in detail above, are overcome.

Figure 12:
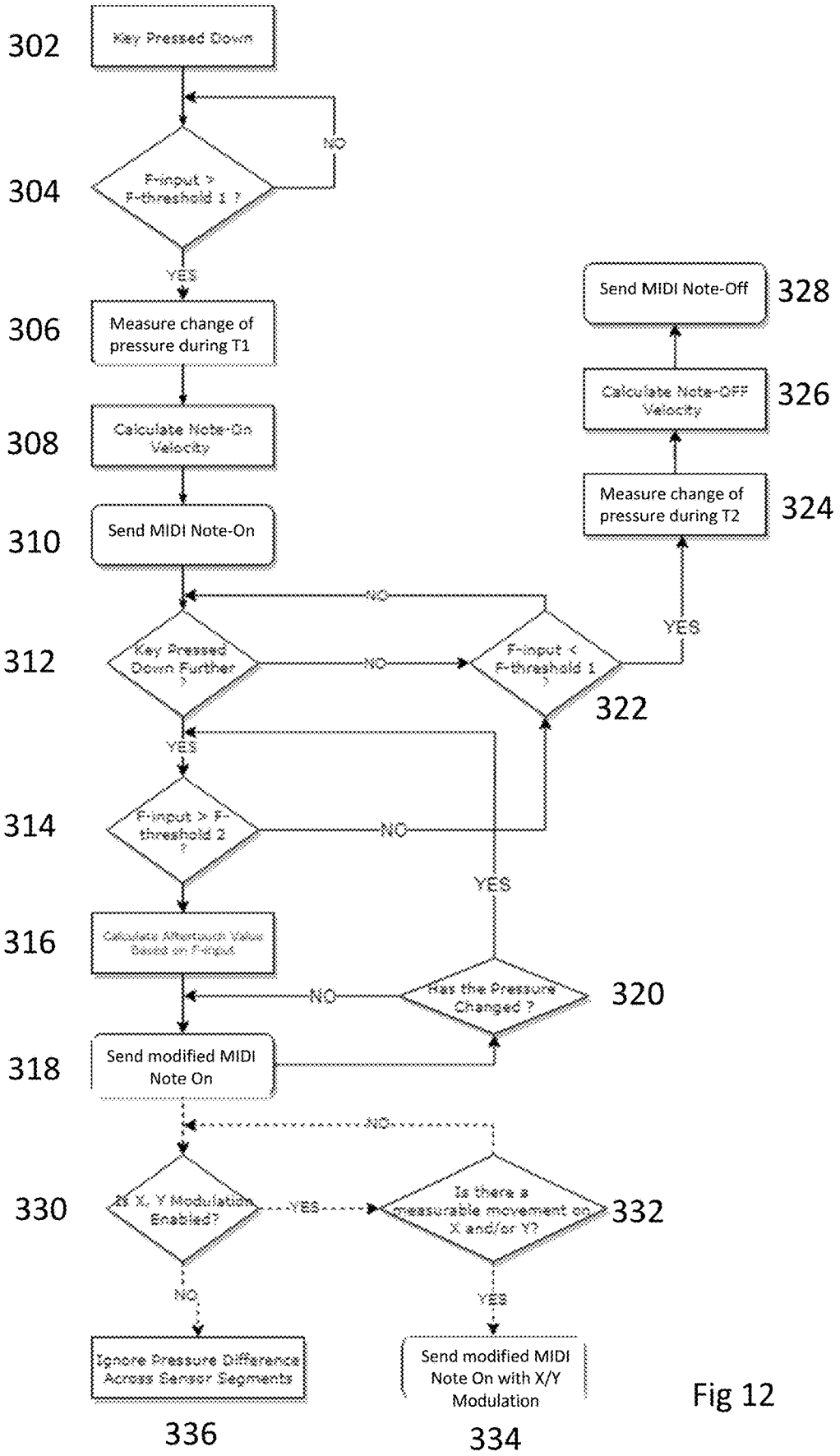
FIG. 12 shows an exemplary method of using the control mechanism of the present disclosure.

Turning now to FIG. 12, a method for using an exemplary arrangement of the device of the present disclosure to generate audio control signals will now be described.

At Block 302, the user depresses a key 201 of the device. As described in relation to FIGS. 2 to 10*b*, the input force provided by the user is transferred from the key 201 to a pressure sensor 207 via a force direction element 203.

At Block 304, the pressure sensor 207 determines whether or not the pressure detected exceeds a first threshold, as described in relation to FIG. 11. If the pressure does not exceed the first threshold, the method repeats the process of Block 304 until the pressure does exceed the first threshold.

Once the pressure exceeds the first threshold, the method moves to Block 306 at which point the change of pressure during a time interval, T1, is determined as also described above in relation to FIG. 11. From the change in pressure determined during this time interval, the velocity of the Note-On event is calculated at Block 308. An audio control signal, in this example a MIDI Note-On signal, is then generated having the velocity characteristic calculated at Block 308. The first threshold can therefore be considered a sound initiation threshold, which is the minimum threshold force that needs to be applied to initiate a sound for the key 201.

At Block 310 the generated audio control signal, in this case a MIDI Note-On signal, is sent. In this example the signal is sent to a loudspeaker to cause the loudspeaker to generate a corresponding audio signal, in other words to play the sound associated with the key 201 depressed at Block 302.

At Block 312 it is determined whether the key 201 is pressed down further, in other words whether the sensor 207 provided beneath the key detects an increase in pressure. If the key 201 is pressed down further then the method progresses to Block 314, where it is determined whether or not the pressure detected at the pressure sensor 207 exceeds a second force threshold, as also described in relation to FIG. 11.

If the pressure detected at the sensor 207 does exceed the second threshold, then an aftertouch effect, in this case an aftertouch value, based on the pressure is calculated at Block 316. The aftertouch effect may be constant or may vary relative to the degree to which the input force exceeds the aftertouch threshold. The aftertouch effect is applied to the audio control signal to produce a modified audio control signal, and the modified audio control signal is then transmitted to the loudspeaker at Block 318. The second threshold can therefore be considered an aftertouch threshold, which is the minimum threshold force that needs to be applied to generate aftertouch effects for the key 201.

The method then progresses to Block 320, where it is determined whether or not the pressure detected at the pressure sensor 207 has changed again. If the pressure detected at the pressure sensor 207 has not changed, then the processor continues to generate and send the same modified audio control signal. The method then loops at Block 318. If, at Block 320, it is determined that the pressure has changed, then the method returns to Block 314.

Once the pressure detected at the pressure sensor 207 falls below the second threshold, then the method progresses from Block 314 to Block 322. The method also progresses to Block 322 if the key is not pressed down further at Block 312.

At Block 322, it is determined whether the pressure detected at the pressure sensor 207 is below the first threshold (the sound initiation threshold). If the pressure detected at the pressure sensor 207 is not below the first threshold then the method progresses to Block 312.

If the pressure detected at the pressure sensor 207 has fallen below the first threshold, then this is indicative of a release of the key 201, in other words a MIDI Note-Off event in this exemplary arrangement. In this case, the method progresses from Block 322 to Block 324, where a change in pressure during a second time interval, T2, is determined. Based on this determined rate of change of pressure, the Note-Off velocity for the audio control signal is determined at Block 326, as described in relation to FIG. 11. The Note-Off audio control signal comprising the calculated velocity characteristic is then sent to the loudspeaker at Block 328.

As described in relation to FIGS. 8*a* to 8*c*, the sensor 207 may comprise a plurality of segments, and may thereby enable modulation of the sound associated with the key 201 in the X and/or Y plane. When this is the case, the method may progress from Block 318 to Block 330.

As Block 330 it is determined whether modulation in the X and/or Y plane is enabled. X/Y modulation may be enabled for one or more keys at manufacture and/or by the user.

If it is determined at Block 330 that X and/or Y modulation is enabled then the method progresses to Block 332, where it is determined whether there is a measurable movement on the X and/or Y plane of the key 201. This may occur if the user rolls or otherwise moves their finger from left to right or back to front across a key. The threshold at which a movement is considered "measurable" will vary based on the setup of the device, and may be pre-determined or variable.

If a measurable movement in the X and/or Y plane is detected across the sensor 207, then a modulation based on this detection is applied to the audio control signal by the processor. The modulation applied may be constant or may vary relative to the size of the measured X/Y movement. The method then progresses to Block 334 where the modified audio control signal including the X/Y modulation effect is transmitted to the loudspeaker.

If a X and/or Y modulation is not enabled at Block 330, then the method progresses to Block 336. At Block 336, pressure differences across sensor segments, for example in the X and/or Y plane are ignored. If no measurable movement is detected in the X and/or Y plane at Block 332, the method returns to Block 330.

As can be seen, the disclosed mechanisms and methods provide an innovative and simplified control mechanism which may be employed for example in a digital keyboard for generating audio control signals. The disclosed mechanism utilises hinged keys, removing the need for any complex pivoting mechanisms to be provided. Accordingly, complexity and cost of manufacture are reduced, and the number of moving parts liable to wear or fail is lessened. The disclosed mechanisms enable a velocity characteristic of the control signal to be determined based on pressure changes. This in turn means that only a single force direction element and a single pressure sensor need to be provided for each key, in contrast with existing digital keyboards that utilise multiple switches and calculate velocity based on time delays across the multiple switches. The disclosed methods and mechanisms therefore provide a simpler device with fewer components, further simplifying manufacture and increasing reliability and durability. In addition, the tactile or haptic feedback provided to the user can change as the functionality of the device changes, for example during different phases of a key depression action. An intuitive and sensitive man-machine interface is therefore provided where the feel of the input mechanism correlates with function. Furthermore, additional input modalities can be provided through the provision of sensors with a plurality of segments.

The above detailed description describes a variety of exemplary arrangements of and methods of using a control mechanism. However, the described arrangements and methods are merely exemplary, and it will be appreciated by a person skilled in the art that various modifications can be made without departing from the scope of the appended claims. Some of these modifications will now be briefly described, however this list of modifications is not to be considered as exhaustive, and other modifications will be apparent to a person skilled in the art.

As mentioned previously, the keyboard in which the control mechanism is provided can comprise any number of keys. In the disclosed arrangements the control mechanism was provided for all keys of the keyboard, however the control mechanism may only be provided for a subset of keys. The disclosed arrangements comprised only a single force direction element, however more than one force direction element can be provided for one or more keys.

The materials described in relation to the various components of the present disclosure are in all cases exemplary. Any suitable material can be used when manufacturing each particular component. The structure of the various components described herein is also merely exemplary. In particular, the type of key, force direction element and sensor utilised may differ from the specific exemplary types described. The force direction element need not comprise a dome switch and pillar structure, but can instead comprise any suitable structure for providing forces to the sensor. The force direction element need not be compressible. The sensor arrangement can comprise any appropriate structure and need not comprise two flexible membranes.

While the above description described a mechanism which gave rise to three distinct phases of the key depression action, this is merely exemplary and there may be more or less than three distinct phases. For example, there may be only one phase during which note initiation occurs. The provision of aftertouch functionality is optional. The provision of an initial free-fall stage before a note is initiated is also optional. Accordingly, components associated with the free-fall and aftertouch stages may not be provided. For example, the keys may not be flexible. The stopper of the above described arrangements may be omitted. The force/displacement characteristics of the mechanism described above are accordingly exemplary and may change depending on the implementation and on which components of the mechanism are omitted.

The aftertouch effects described above are also merely exemplary, and other aftertouch effects and modulations that could be applied to the audio control signal will be apparent to a person skilled in the art. Any suitable other digital modulations or manipulations can be applied to the audio control signal.

The velocity characteristic of the control signal may be determined during a pre-determined time interval, as in the examples described above. Alternatively, a dynamic time interval may be used. For example, dynamic filtering techniques may be employed to change the time interval based on the noise level. In one example, there may exist a time-dependent noise element, such as drift of the pressure reading provided by the sensor resulting from temperature change. For example, a baseline value might vary slowly due to temperature change or other slowly changing factors that impact the resistivity of one or more elements of the system. In this case, it may be beneficial to run raw sensor data through a high-pass filter, which effectively changes the time interval constant, resulting in a dynamic time interval. As will be apparent many other signal processing techniques can be deployed in a similar manner depending on the issues to be addressed, and appropriate dynamic time intervals can be used to account for the requirements of each scenario.

Where a PCB is utilised, the PCB does not need to be located beneath the sensor(s), for example, but can be located in any suitable location which enables communication with the sensor(s). Where the sensor arrangement is a standalone component, the sensor arrangement can be provided on any suitable surface. Alternatively, other pressure sensor designs may be used where the sensor arrangement is incorporated into another component such as the PCB. The sensor arrangement described above is merely exemplary and any suitable sensor arrangement can be used.

While various specific combinations of components and method steps have been described, these are merely exemplary. Components and method steps may be combined in any suitable arrangement or combination. Components and method steps may also be omitted to leave any suitable combination of components or method steps.

The described methods may be implemented using a computer, in particular a computer processor, and a computer program comprising computer executable instructions which can be executed by the computer processor. A computer program product or computer readable medium may comprise or store the computer program. The computer program product or computer readable medium may comprise a hard disk drive, a flash memory, a read-only memory (ROM), a CD, a DVD, a cache, a random-access memory (RAM) and/or any other storage media in which information is stored for any duration (e.g., for extended time periods, permanently, brief instances, for temporarily buffering, and/or for caching of the information). The computer readable medium may be a tangible or non-transitory computer readable medium. The term "computer readable" encompasses "machine readable".

Figure 13:
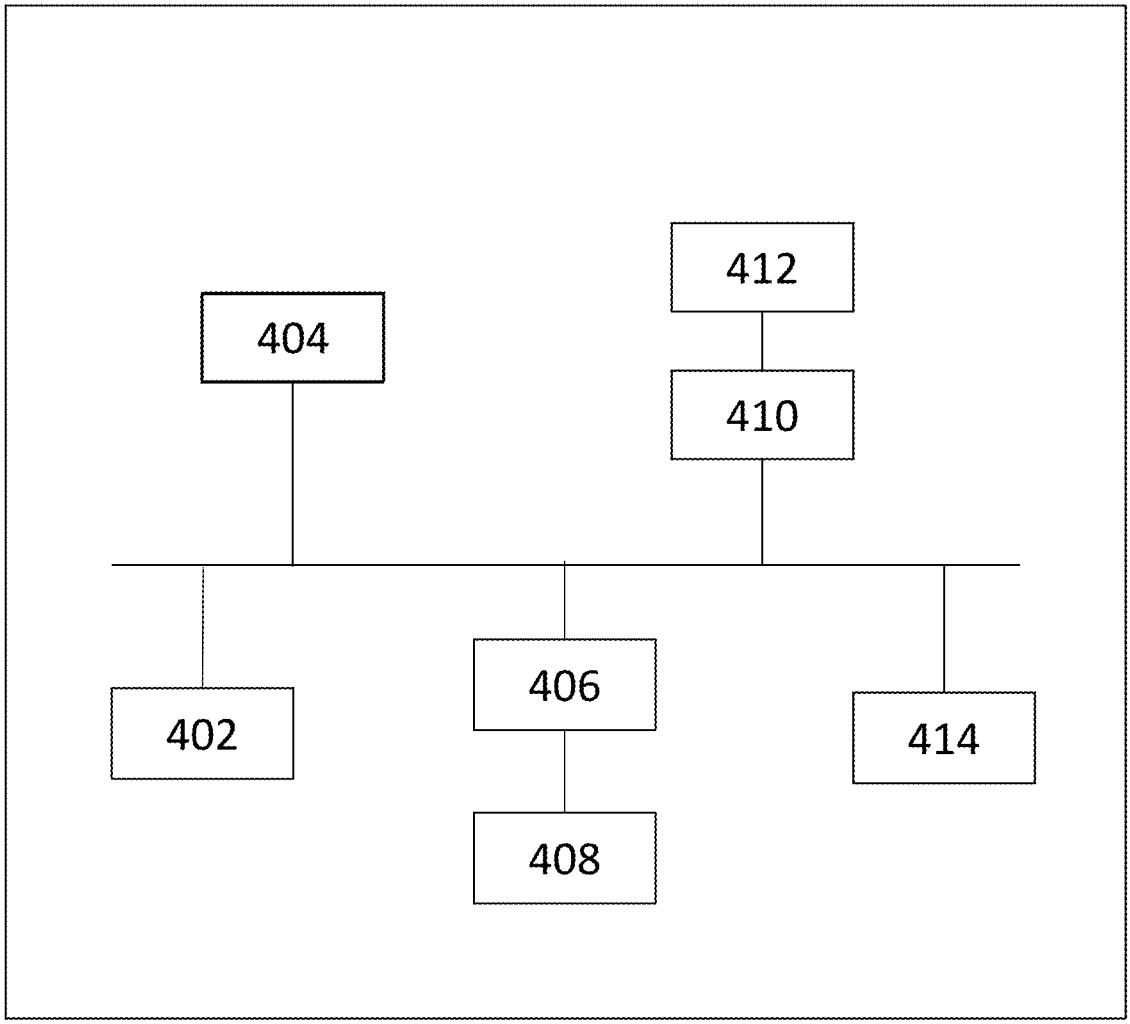
FIG. 13 shows the components of a computer that can be used to implement the methods described herein.

FIG. 13 shows a schematic and simplified representation of a computer apparatus 400 which can be used to perform the methods described herein, either alone or in combination with other computer apparatuses. The computer apparatus 400, or components thereof, may be incorporated into a device, such as a digital keyboard, comprising the control mechanisms of the present disclosure. Alternatively, the computer apparatus 400 may be provided externally to the device comprising the control mechanisms of the present disclosure.

The computer apparatus 400 comprises various data processing resources such as a processor 402 coupled to a central bus structure. Also connected to the bus structure are further data processing resources such as memory 404. A display adapter 406 connects a display device 408 to the bus structure. One or more user-input device adapters 410 connect a user-input device 412, such as the keys or other input mechanisms of the present disclosure to the bus structure. One or more communications adapters 414 are also connected to the bus structure to provide connections to other computer systems 400 and other networks.

In operation, the processor 402 of computer system 400 executes a computer program comprising computer-executable instructions that may be stored in memory 404. When executed, the computer-executable instructions may cause the computer system 400 to perform one or more of the methods described herein. The results of the processing performed may be displayed to a user via the display adapter 606 and display device 408. User inputs for controlling the operation of the computer system 400 may be received via the user-input device adapters 410 from the user-input devices 412.

It will be apparent that some features of computer system 400 shown in FIG. 13 may be absent in certain cases. For example, one or more of the plurality of computer apparatuses 400 may have no need for display adapter 406 or display device 408. Similarly, user input device adapter 410 and user input device 412 may not be required. In its simplest form, computer apparatus 400 comprises processor 402 and memory 404.

In the foregoing, the singular terms "a" and "an" should not be taken to mean "one and only one". Rather, they should be taken to mean "at least one" or "one or more" unless stated otherwise. The word "comprising" and its derivatives including "comprises" and "comprise" include each of the stated features but does not exclude the inclusion of one or more further features.

The above implementations have been described by way of example only, and the described implementations are to be considered in all respects only as illustrative and not restrictive. It will be appreciated that variations of the described implementations may be made without departing from the scope of the invention. It will also be apparent that there are many variations that have not been described, but that fall within the scope of the appended claims.

The invention claimed is:

1. A controller for producing control signals, comprising:

a pressure sensor;

a hinged input mechanism configured to:

receive input forces between a hinge point and a front end of the hinged input mechanism; and direct said input forces towards the pressure sensor; and a processor, configured to receive a signal from the pressure sensor indicating that the hinged input mechanism is being depressed or released and, based on the received signal, further configured to:

determine, during a time interval, a rate of change of pressure detected at the pressure sensor resulting from the input forces received between the hinge point and the front end of the hinged input mechanism; and generate a control signal associated with the hinged input mechanism;

wherein the control signal comprises a velocity characteristic representative of a speed at which the hinged input mechanism is depressed or released, and wherein the velocity characteristic of the control signal is based at least partly on the determined rate of change of pressure resulting from the input forces received between the hinge point and the front end of the hinged input mechanism.

2. The controller of claim 1, wherein the control signal is an audio control signal.

3. The controller of claim 2, wherein the processor is further configured to generate a modified version of the audio control signal comprising aftertouch characteristics when the pressure detected at the pressure sensor is above a threshold; wherein generating the modified audio control signal optionally comprises modifying the initial control signal so that it comprises one or more of:

a vibrato effect;

a pitch bending effect;

a modified volume;

a modified timbre;

a modified rhythm;

an additional sound type; and a spatial effect, optionally a delay, reverb and/or panning effect.

4. The controller of claim 2, wherein the processor is further configured to generate a modified version of the audio control signal comprising aftertouch characteristics when a pressure detected at the pressure sensor is above a threshold, and wherein the processor is configured to further modify the audio control signal when the pressure detected at the pressure sensor changes but remains above the first threshold.

5. The controller of claim 2, wherein the audio control signal generated is a MIDI Note On message or a MIDI Note Off message.

6. The controller of claim 2, comprising a plurality of hinged input mechanisms and wherein the processor is configured to generate an individual audio control signal with individual aftertouch characteristics for each respective hinged input mechanism, the audio control signal and associated aftertouch characteristics for each respective hinged input mechanism being independent of the audio control signal and associated aftertouch characteristics for each other hinged input mechanism, wherein the processor is optionally configured to generate more than one individual audio control signal with individual aftertouch characteristics concurrently.

7. The controller of claim 1, wherein the hinged input mechanism is configured to provide a first returning force in response to being depressed, the first returning force being operable to return the hinged input mechanism to a rest position.

8. The controller of claim 1, further comprising:

a force direction element provided between the hinged input mechanism and the pressure sensor, wherein the force direction element is configured to direct input forces applied to the hinged input mechanism to the pressure sensor, wherein the force direction element is optionally compressible.

9. The controller of claim 8, wherein the force direction element is configured to exert a second returning force on the hinged input mechanism when the hinged input mechanism is depressed, the second returning force being operable to return the hinged input mechanism toward a rest position.

10. The controller of claim 1, further comprising a stopper arranged to engage the hinged input mechanism when the hinged input mechanism is depressed by a pre-determined distance, wherein the stopper is optionally compressible.

11. The controller of claim 10, wherein the stopper is configured to exert a third returning force on the hinged input mechanism when the hinged input mechanism is depressed beyond the pre-determined distance, the third returning force being operable to return the hinged input mechanism toward a rest position.

12. The controller of claim 10, the controller further comprising a force direction element provided between the hinged input mechanism and the pressure sensor, wherein the force direction element is configured to direct input forces applied to the hinged input mechanism to the pressure sensor, wherein the force direction element is optionally compressible, wherein the force direction element is configured to exert a second returning force on the hinged input mechanism when the hinged input mechanism is depressed, the second returning force being operable to return the hinged input mechanism toward a rest position, wherein the stopper is configured to exert a third returning force on the hinged input mechanism when the hinged input mechanism is depressed beyond the pre-determined distance, the third returning force being operable to return the hinged input mechanism toward a rest position, and wherein the returning force exerted on the hinged input mechanism by the force direction element increases at a slower rate than the returning force exerted on the hinged input mechanism by the stopper, relative to the distance by which the input mechanism is depressed.

13. The controller of claim 1, further comprising:

a force direction element provided between the hinged input mechanism and the pressure sensor, wherein the force direction element is configured to direct input forces applied to the hinged input mechanism to the pressure sensor, wherein the force direction element is optionally compressible, a stopper arranged to engage the hinged input mechanism when the hinged input mechanism is depressed by a pre-determined distance, wherein the stopper is optionally compressible, wherein the hinged input mechanism is configured to provide a first returning force in response to being depressed, the first returning force being operable to return the hinged input mechanism to a rest position, wherein the force direction element is configured to exert a second returning force on the hinged input mechanism when the hinged input mechanism is depressed, the second returning force being operable to return the hinged input mechanism toward a rest position, wherein the stopper is configured to exert a third returning force on the hinged input mechanism when the hinged input mechanism is depressed beyond the pre-determined distance, the third returning force being operable to return the hinged input mechanism toward a rest position, and wherein the returning force provided by the hinged input mechanism increases at a slower rate than both the returning force exerted on the hinged input mechanism by the force direction element and the returning force exerted on the hinged input mechanism by the stopper, relative to the distance by which the input mechanism is depressed.

14. The controller of claim 1, wherein the pressure sensor comprises a plurality of segments and wherein the processor is further configured to modify the control signal based on the pressure detected at each of the plurality of segments of the pressure sensor, wherein the processor is optionally further configured to interpolate a plurality of pressure data signals received from the pressure sensor to derive a centroid location of the input to the pressure sensor across the plurality of segments.

15. The controller of claim 1, comprising a plurality of hinged input mechanisms arranged above a pressure sensing component, wherein the pressure sensing component comprises a plurality of pressure sensors and wherein at least one pressure sensor is provided beneath each hinged input mechanism, wherein the pressure sensing component is connected to a printed circuit board, PCB, for collection of the sensor data generated by the plurality of pressure sensors.

16. A digital keyboard comprising the controller of claim 1.

17. A computer-implemented method of generating a control signal for performing by a processor, the method comprising:

receiving a signal from a pressure sensor, the received signal indicating that a hinged input mechanism is being depressed or released between a hinge point and a front end of the hinged input mechanism;

based on the received signal:

determining, during a time interval, a rate of change of pressure detected at the pressure sensor resulting from the signal received between the hinge point and the front end of the hinged input mechanism; and generating a control signal associated with the hinged input mechanism;

wherein the control signal comprises a velocity characteristic representative of a speed at which the hinged input mechanism is depressed or released, and wherein the velocity characteristic of the control signal is based at least partly on the determined rate of change of pressure resulting from the input forces received between the hinge point and the front end of the hinged input mechanism.

18. A computer-readable medium comprising computer-executable instructions which, when executed by one or more computers, cause the one or more computers to perform the method of claim 17.

19. A computer system having a processor and memory, wherein the memory comprises computer-executable instructions which, when executed, cause the computer to perform the method of claim 17.

* * * * *